US012421704B2

(12) United States Patent
Levi

(10) Patent No.: US 12,421,704 B2
(45) Date of Patent: Sep. 23, 2025

(54) ACCESSIBLE SUBFLOOR BATH

(71) Applicant: Jonathan Levi, Boston, MA (US)

(72) Inventor: Jonathan Levi, Boston, MA (US)

( * ) Notice: Subject to any disclaimer, the term of this patent is extended or adjusted under 35 U.S.C. 154(b) by 0 days.

(21) Appl. No.: 19/191,206

(22) Filed: Apr. 28, 2025

(65) Prior Publication Data

US 2025/0250784 A1 Aug. 7, 2025

Related U.S. Application Data

(63) Continuation-in-part of application No. 18/921,563, filed on Oct. 21, 2024, now Pat. No. 12,291,856, which is a continuation of application No. 18/390,611, filed on Dec. 20, 2023, now Pat. No. 12,129,635.

(60) Provisional application No. 63/433,858, filed on Dec. 20, 2022.

(51) Int. Cl.
*E03C 1/23* (2006.01)
*E03C 1/232* (2006.01)

(52) U.S. Cl.
CPC ..... *E03C 1/2306* (2013.01); *E03C 1/232* (2013.01)

(58) Field of Classification Search
CPC ..... E03C 1/2306; E03C 1/232; E04H 4/065; A61H 33/60
USPC ..... 4/490, 495, 541.1–541.6, 560.1, 564.1, 4/656.1, 651, 653, 662, 680
See application file for complete search history.

(56) References Cited

U.S. PATENT DOCUMENTS 3,935,600 A * 2/1976 Scribner ..... E04H 4/065 4/495
4,106,134 A * 8/1978 Schiron ..... E04H 4/065 4/495
5,862,545 A * 1/1999 Mathis ..... A61H 33/60 4/662
2014/0237713 A1* 8/2014 Kanetis ..... E04H 4/065 4/495

* cited by examiner

*Primary Examiner* — Tuan N Nguyen
(74) *Attorney, Agent, or Firm* — Nutter McClennen & Fish LLP

(57) ABSTRACT

A system may include one or more of a tub that provides tub access to a seated user and includes a top surface, a bottom surface, and a concave well therebetween, a platform that includes water openings extending therethrough, a lift, coupled to a bottom surface of the platform, the lift disposed within the tub and configured to lower the platform within the well, and a plurality of jets around an inner periphery of the well, configured to apply a liquid cleaning solution within the tub in response to the lift and the platform are in a raised position and water has been drained from the well.

20 Claims, 15 Drawing Sheets

ACCESSIBLE SUBFLOOR BATH

PRIORITY

This patent application is a continuation-in-part application of U.S. patent application Ser. No. 18/921,563, filed Oct. 21, 2024, entitled, ACCESSIBLE SUBFLOOR BATH and naming Jonathan Levi as the inventor, which is a continuation application of U.S. patent application Ser. No. 18/390,611, filed Dec. 20, 2023, now U.S. Pat. No. 12,129,635, which claims priority from provisional U.S. patent application No. 63/433,858, filed Dec. 20, 2022, the disclosures of each of which are incorporated herein, in their entireties, by reference.

FIELD

Illustrative embodiments of the invention generally relate to building architecture and, more particularly, various embodiments of the invention relate to bathing facility construction.

BACKGROUND

Typical bath systems that are configured to be accessible to mobility-impaired people include walk-in tubs and open shower stalls. Many conventional walk-in tubs may restrict access from people that rely on a wheelchair to move about. Additionally, many walk-in showers do not allow for a bathtub to be fitted in the same footprint, which would save space while allowing one to have both a shower and a bath in one room. Open shower stalls often do not allow for a bath.

SUMMARY OF VARIOUS EMBODIMENTS

In accordance with one embodiment of the invention, a system may include one or more of a tub that provides tub access to a seated user and includes a top surface, a bottom surface, and a concave well therebetween, a platform that includes water openings extending therethrough, a lift, coupled to a bottom surface of the platform, the lift disposed within the tub and configured to lower the platform within the well, and a plurality of jets around an inner periphery of the well, configured to apply a liquid cleaning solution within the tub in response to the lift and the platform are in a raised position and water has been drained from the well.

In accordance with other embodiments, the system may include a pump, coupled to the plurality of jets, configured to distribute the liquid cleaning solution through the plurality of jets at a predetermined pressure.

In accordance with other embodiments, the system may include a controller, coupled to the pump, configured to pressurize the liquid cleaning solution in response to a cleaning control activation.

In accordance with other embodiments, the system may include a cleaning fluid reservoir, configured to store a concentrated cleaning solution, a water supply, configured to provide one or more of cold or heated water, and a mixer, coupled to the cleaning solution reservoir and the water supply, configured to combine the concentrated cleaning solution with the one or more of cold or heated water at a predetermined concentration to produce the liquid cleaning solution, where the mixer is coupled to an inlet of the pump.

In accordance with other embodiments, the system may include a timer, configured to modulate the pump and mixer to apply the liquid cleaning solution to the well, disable the pump for a time period, rinse the well with the one or more of the cold or heated water to the well, and disable the pump and the mixer.

In accordance with other embodiments, the plurality of jets may include one or more lower side jets and one or more upper side jets, disposed above the lower side jets.

In accordance with other embodiments, the plurality of jets may include fixed jets configured to apply the liquid cleaning solution to opposite interior surfaces of the well.

In accordance with other embodiments, the plurality of jets may include one or more directional jets configured to apply the liquid cleaning solution to different surfaces of the well in a repeating pattern.

In accordance with another embodiment of the invention, a system may include a tub, configured to hold water, a drain, disposed in proximity to a bottom surface of the tub, configured to retain water within a well when closed and allow water to drain from the well when opened, a platform, configured to fit within the opening when in a raised position, a lift, affixed to an underside of the platform, configured to raise the platform to the raised position and lower the platform within the well, and a plurality of jets around an inner periphery of the well, configured to apply a liquid cleaning solution within the well in response to the lift and the platform are in the raised position and water has been drained from the well. The tub may include the top and bottom surfaces and the concave well, affixed and conforming to an opening at the top surface.

In accordance with other embodiments, the system may include a pump, coupled to the plurality of jets, and a controller, configured to modulate the pump to provide the liquid cleaning solution to the plurality of jets in response to a cleaning control activation, the platform is in the raised position, and water is drained from the well.

In accordance with other embodiments, in response to the platform is not in the raised position or water is not drained from the well when the cleaning control activation occurs, the controller is configured to raise the platform to the raised position and drain the water from the well prior to the controller modulates the pump.

In accordance with other embodiments, the system may include a mixer, coupled to the controller and the pump, configured to combine a concentrated cleaning solution with water as directed by the controller, the combination used to wash the inside of the well followed by rinsing with water.

In accordance with another embodiment of the invention, a method may include one or more of receiving a cleaning control activation, and in response draining water within a well of a tub, in response to the drain is closed, raising, by a lift coupled to a platform within the tub, the platform to a raised position in response to the platform is not in the raised position, the raised position being coplanar with a top surface of the tub, and in response applying, by a plurality of jets around an inner periphery of the well, a liquid cleaning solution within the tub.

In accordance with other embodiments, the method may include distributing, by a pump coupled to the plurality of jets, the liquid cleaning solution to the tub at a predetermined pressure.

In accordance with other embodiments, the method may include pressurizing, by a controller coupled to the pump, the liquid cleaning solution in response to a cleaning control activation.

In accordance with other embodiments, the method may include storing, by a cleaning fluid reservoir, a concentrated cleaning solution, providing, by a water supply, one or more of cold or heated water, and combining, by a mixer coupled to the cleaning solution reservoir and the water supply, the concentrated cleaning solution with the one or more of cold or heated water at a predetermined concentration to produce the liquid cleaning solution, where the mixer is coupled to an inlet of the pump.

In accordance with other embodiments, the method may include modulating, by a timer associated with the controller, the pump and mixer by applying the liquid cleaning solution to the well, disabling the pump for a time period, rinsing the well with the one or more of the cold or heated water to the well, and disabling the pump and the mixer.

In accordance with other embodiments, in response to the cleaning control activation, the method may include determining, by the controller, a user is on the platform, and in response providing a request to the user to leave the platform, and inhibiting applying the liquid cleaning solution within the tub until the controller determines the user is not on the platform.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a subfloor accessible bath (also referred to herein as the "accessible bath") safely provides tub access to a seated user. The user may be seated on a seat, platform, or wheelchair on a platform, and the user or another individual may initiate lowering the platform within a well of the tub. The platform allows water to pass through it into the tub and may be lowered to a given depth within the tub. When use of the tub is concluded, the user or other individual may initiate raising the platform until the platform is flush or nearly flush with a floor level. The user may safely step off the platform or move a wheelchair off the platform.

Certain conventional art accessible baths known to the inventor include walk-in bathtubs (e.g., having a sealable door or stairs into the basin) and/or open-concept showers (e.g., shower stalls without doors or rims). However, these types of baths occupy significant floor space or may not be suitable for mobility-impaired users. Illustrative embodiments of the present invention solve this problem. Specifically, in illustrative embodiments, an accessible bath is provided for people having various levels of mobility. Accordingly, while typically only mobile or semi-mobile people can access a walk-in bathtub, the accessible bath is accessible to people lacking the ability to walk as well as people able to walk. The accessible bath includes a lift positioned within a tub such that the bather can be safely lowered into the tub. Additionally, the rim of the tub preferably rests level with the surrounding floor providing access to users of many levels of mobility. Details of various embodiments are discussed below.

Figure 1A:
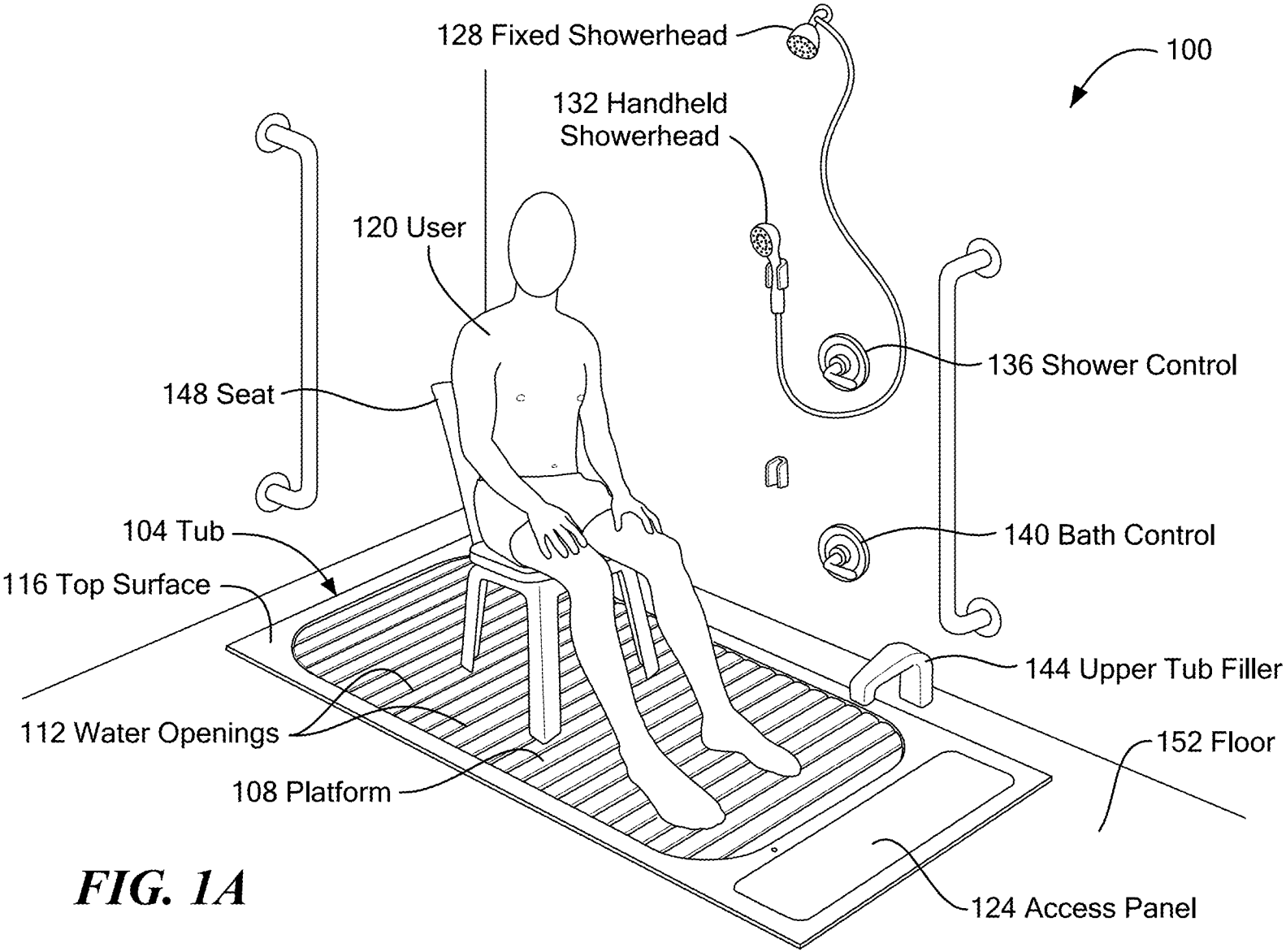
FIG. 1A schematically shows a perspective view of an accessible bath in a raised position with a seated user in accordance with illustrative embodiments of the invention.

FIG. 1A schematically shows a perspective view 100 of an accessible bath in a raised position with a seated user in accordance with illustrative embodiments of the invention. As shown in FIG. 1A, the accessible bath 100 may include a tub 104 with a tub top surface 116, a platform 108 with water openings 112 therethrough for moving up and down within the tub 104, and an access panel 124 to provide access to internal system components. As shown, a user 120 may be seated on a seat or chair 148 atop the platform 108. The seat or chair 148 may be affixed to a top surface of the platform 108 or placed on the platform 108. The top surface 116 of the tub 104 may be approximately level with the floor 152 of the bath area.

FIG. 1A illustrates the platform 108 in a raised position, where the accessible bath may be used to shower the user 120 in either a seated or a standing position. Water from the fixed showerhead(s) 128 or handheld showerhead(s) 132 may drain through the water openings 112 to one or more drains within the tub 104 (shown in FIG. 3). The platform 108 in this embodiment is generally planar and remains in a generally parallel orientation to the floor 152 at all times.

This may be required for user 120 safety. FIG. 1A also illustrates the accessible bath in the raised position with the user 120 safely seated and prior to the platform 108 being lowered within the tub 104.

The area around the accessible bath 100 may include various fixtures to provide water to the user 120 and control the accessible bath 100, including any number of fixed showerheads 128, any number of handheld showerheads 132, any number of shower controls 136, any number of bath controls 140, and any number of upper tub fillers 144. The fixed showerheads 128, handheld showerheads 132, shower controls 136, and bath controls 140 may be on any mounting surface(s) of the accessible bath 100, including a vertical surface in front of, behind, or to the side or angled with respect to the user 120. The floor 152 may include any number of drains in addition to drains specifically discussed herein. Walls adjacent to the accessible bath 100 may include one or more grab bars or supports to facilitate the user 120 resting on the seat 148 or standing. The access panel 124 may allow access to various electrical, plumbing, and control devices associated with the accessible bath 100 for maintenance, cleaning, and replacement purposes.

As noted above, the platform 108 is preferably flat and coplanar with the floor 152 when in the raised position. In illustrative embodiments, the platform 108 includes a series of evenly spaced slats or boards with water openings 112 between adjacent slats. In another embodiment, the platform 108 may be a flat surface and the water openings 112 may be holes of any particular shape, pattern, or regularity. For safety reasons, the water openings 112 may be small enough to keep fingers or toes from becoming lodged or stuck in the openings 112. The water openings 112 may also be sufficiently small such that wheelchair wheels can traverse the water openings 112 without becoming stuck or inhibiting wheelchair movement. In one embodiment, the floor 152 may be sloped (e.g., at a slight non-zero angle relative to the floor) to cause water flow to and through the platform 108. In one embodiment, the accessible bath 100 may include one or more upper tub fillers 144 that provide water directly to the tub 104 rather than through showerheads 128, 132. This may beneficially keep water within the tub 104 and facilitate cleaning for the accessible bath 100.

The platform 108 may be constructed from flat and rigid materials that do not absorb water, such as polymer or treated wood slats. For example, the slats may be teak, white oak, maple, cedar, or any water-resistant wood. In other examples, the slats may be constructed from crosslinked vinyl, crosslinked polystyrene, polycarbonate, acrylonitrile butadiene styrene (ABS), or any supportive polymer or copolymer. In other examples, the slats may be metal, glass, ceramic, stone, any suitable slat material, or any combination thereof.

Figure 1B:
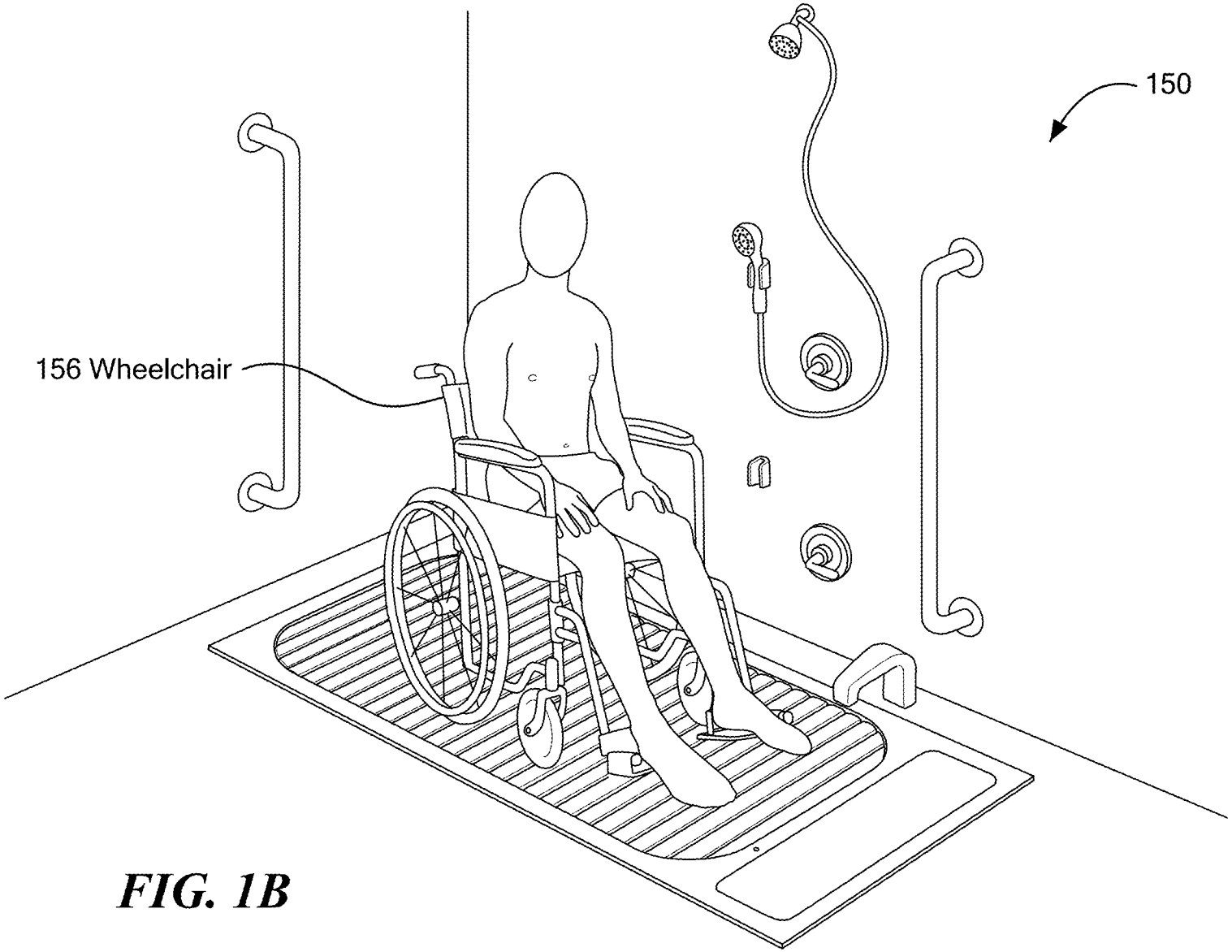
FIG. 1B schematically shows a perspective view of an accessible bath in a raised position with a user seated in a wheelchair in accordance with illustrative embodiments of the invention.

FIG. 1B schematically shows a perspective view 150 of an accessible bath in a raised position with a user seated in a wheelchair in accordance with illustrative embodiments of the invention. As shown in FIG. 1B, a user 120 in a wheelchair 156 may be able to safely use the accessible bath 150, both for conventional showering as previously described or bathing within the tub 104. Because of the general coplanarity of the platform 108 in a raised position with the floor 152, the user 120 in a wheelchair 156 may easily move the wheelchair 156 onto a center portion of the platform 108 before lowering the platform 108. In one embodiment, the platform 108 may have a width to accommodate common wheelchairs 156.

Figure 2:
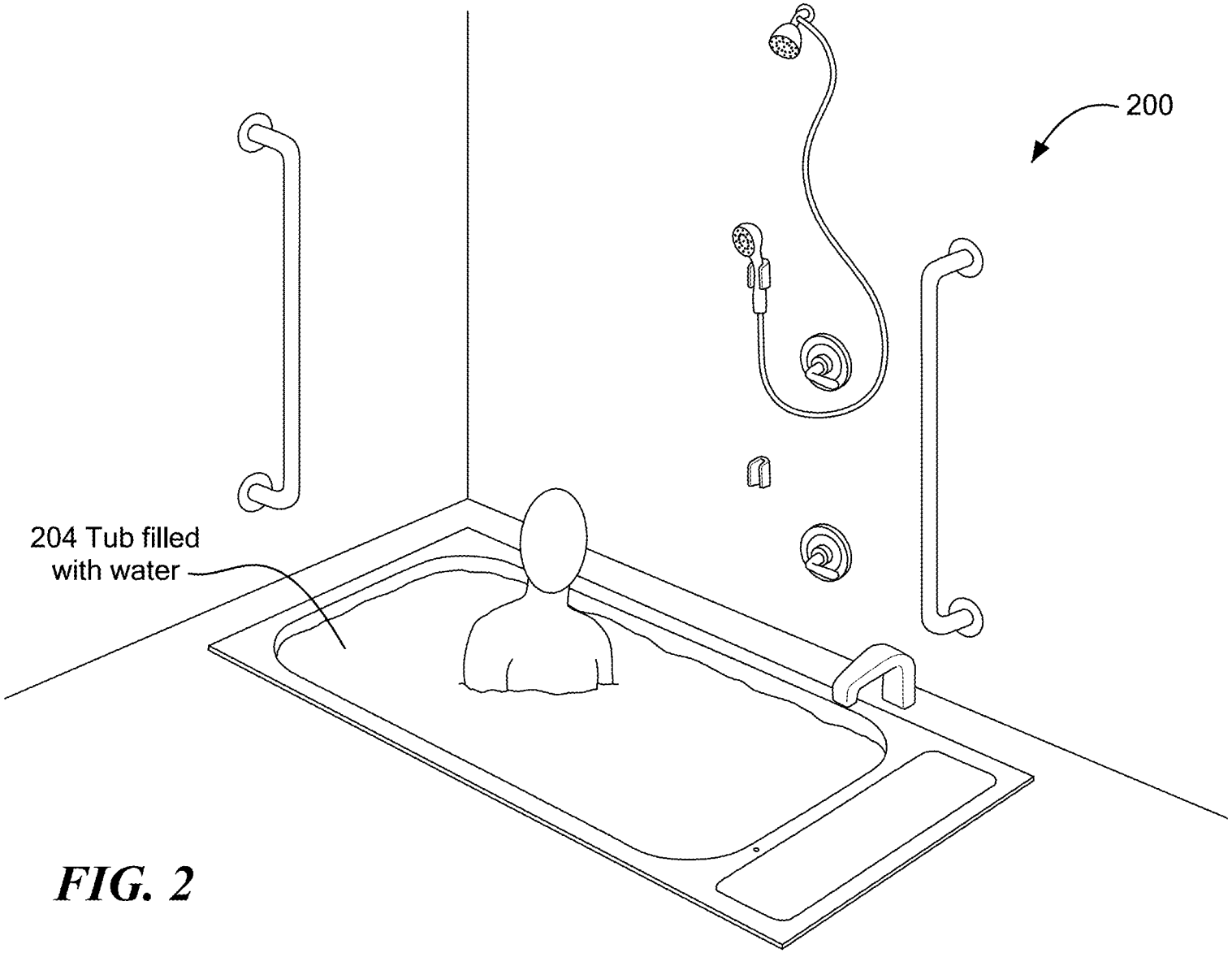
FIG. 2 schematically shows a perspective view of an accessible bath in a lowered position with water in the tub in accordance with illustrative embodiments of the invention.

FIG. 2 schematically shows a perspective view 200 of an accessible bath in a lowered position with water in the tub in accordance with illustrative embodiments of the invention. As shown in FIG. 2, a user 120 may be immersed in the tub filled with water 204, including up to a chest or shoulder level as shown. In one embodiment, the platform 108 may be in a lowered position. In another embodiment, the platform 108 may be moved to a number of predetermined depths between the maximum lowered position and the raised position (e.g., 25% lower, 50% lower, 75% lower, or 100% lower). In another embodiment, the platform 108 may be lowered to any depth selected by the user 120 or other individual between the raised position and a 100% lowered position. This may beneficially provide great flexibility to accommodate different users 120 with different heights or to customize the water depth for specific therapeutic uses (e.g., foot or ankle bath).

Figure 3A:
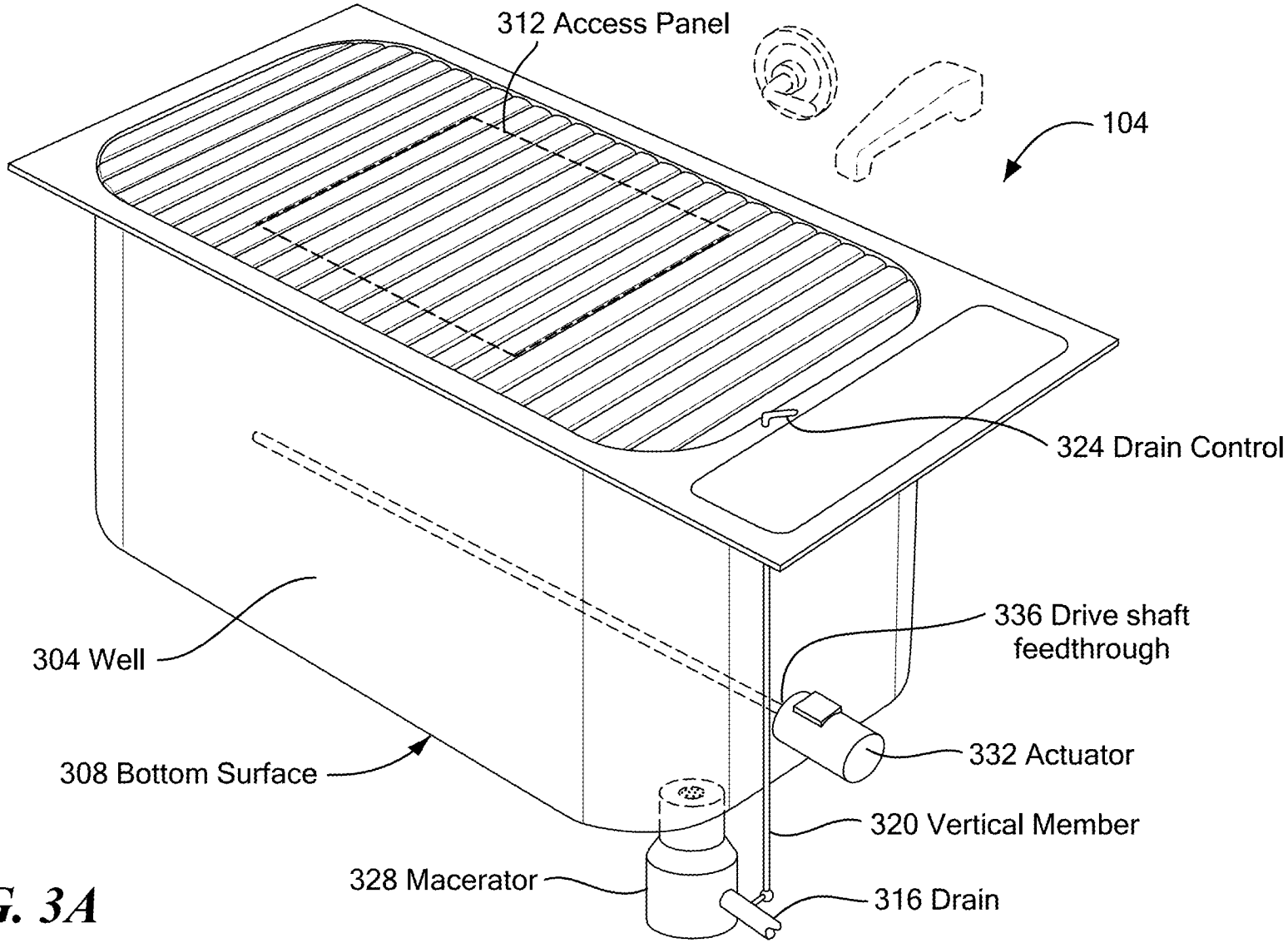
FIG. 3A schematically shows a perspective view of a tub in accordance with illustrative embodiments of the invention.

FIG. 3A schematically shows a perspective view of the tub 104 in accordance with illustrative embodiments of the invention. FIG. 3 illustrates the tub 104 with the platform 108 in the raised position and with various additional features shown and reflect the tub 104 just prior to installation within a shower area of a building.

The tub 104 may include a well 304 with upwardly extending sides (e.g., generally vertical or at some angle to the vertical) and a bottom surface 308. The length and width may be of many different dimensions, although a length under 6 feet, a width under 3.5 feet, and a depth below 4 feet may be common. As with any tub, the illustrative tub 104 is configured to hold water for a bath. The tub 104 may be made from a molded polymer, an extruded polymer, an extruded metal, a stamped metal, glass, concrete, frame and tile, frame and liner, any basin construct, or any combination thereof. In certain embodiments, the tub 104 may have a volume (i.e., the well volume), an opening at its top, and vertical dimension (e.g., depth) sufficient to immerse a person in a wheelchair 156 up to the user's 120 shoulders and/or neck, assuming the user 120 is of a certain height and weight. For example, the tub 104 may be produced having opening dimensions equivalent or comparable to a standard in-home bathtub.

The tub 104 has a drain 316 proximate the bottom surface 308 to allow water to drain from the well 304. The drain 316 may have a vertical member 320 coupled to a drain control 324. The drain control 324 allows the user 120 or other individual to close the drain 316 when filling the tub 104 or open the drain 316 to allow water to leave the tub 104.

In further embodiments, the tub 104 may be a jetted tub. A jetted tub may provide certain therapeutic or medical benefits to certain users of the accessible bath. Jet quantity and position may be determined on an as-needed or as-desired basis. Jet direction and water flow may be user adjustable. In further embodiments, the tub 104 may have one or more lights in the top surface 116, the well 304, and/or the bottom surface 308. In some embodiment, the lights may be fixed, selectable, or changing colors or brightness.

In some embodiments, the tub 104 is configured to provide a seamless transition from the floor 152 of the building having the accessible bath installed, and the tub top surface 116. For example, the tub 104 may be positioned on a subfloor cut-out configured to support the accessible bath with installed flooring material butting against the top surface 116. In certain embodiments, a wedge or small ramp can be deployed about the tub 104 to provide a smooth transition from the surrounding floor 152 to the tub 104. As used herein, a smooth transition may be a transition from the floor 152 surrounding the tub 104 onto the top surface 116 that does not impede access from a mobility-impaired person, a wheelchair, or any person using the accessible bath.

In some embodiments (as shown), the accessible bath may include a macerator 328 coupled to the drain 316. The macerator 328 reduces the size of solids to smaller pieces to prevent water outlets and wastewater pipes from becoming clogged. In one embodiment, the macerator 328 may include a motor that drives teeth or other mechanical cutters that reduces solids. The macerator 328 may be controlled by various means, as described herein. In one embodiment, the macerator 328 operates whenever the drain 316 is open and water flows through the drain 316 and may be inhibited from running if either the drain 316 is closed or there is no water flowing through the drain 316.

In some embodiments, the accessible bath may include an actuator or lift actuator 332 that controls raising and lowering the platform 108, as described herein. In illustrative embodiments, the actuator 332 may be outside the well 304 and accesses a lift through a drive shaft feedthrough 336 that provides a water-tight seal about a drive mechanism configured to operate the lift. For example, the feedthrough 336 may include a magnetic feedthrough, an o-ring sealed feedthrough, an oil-sealed feedthrough, a cutlass-type waterproof bearing, or any combination thereof. The actuator 332 may be implemented with a motor. Among other things, the motor may be any one of a direct drive motor, an indirect drive motor, an AC electric motor, a DC electric motor, a stepper motor, a servo motor, a hydraulic motor, a compressed air motor, a capacitor-start natural gas and/or propane motor, or any suitable motor. In a preferred embodiment, the motor is a low voltage direct drive motor.

Figure 3B:
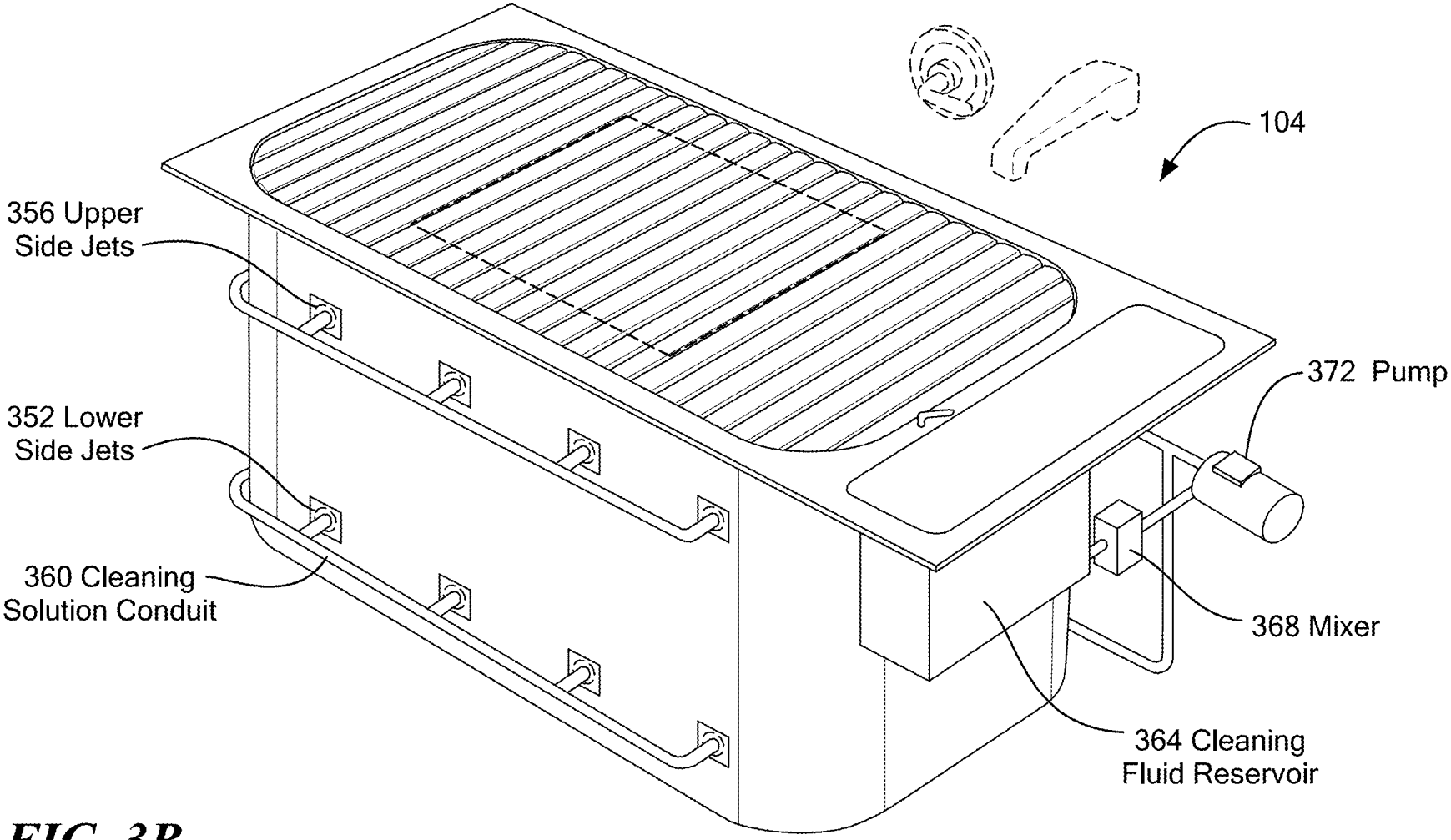
FIG. 3B schematically shows a perspective view of cleaning system for a tub in accordance with illustrative embodiments of the invention.

FIG. 3B schematically shows a perspective view of cleaning system for a tub in accordance with illustrative embodiments of the invention. The unique components of FIG. 3B may also be present in the system illustrated in FIG. 3A. Although the vertical member 320, drain 316, drain control 324, actuator 332, and drive shaft feedthrough 336 are not shown in FIG. 3B, these components are assumed to be present.

FIG. 3B illustrates specific components associated with the cleaning system for the tub 104. The cleaning system includes a cleaning fluid reservoir 364 that stores cleaning fluid to clean the inside of the tub 104 and underside of the platform 108. It may also clean members associated with the lift 408, the worm gear 412, and in some embodiments the actuator 728 of FIG. 7B. In one embodiment, the cleaning fluid is a concentrated fluid intended to be diluted by a mixer 368. In another embodiment, the cleaning fluid may be in a ready-to-use concentration that does not require further dilution. The cleaning fluid reservoir 364 includes one or more means to add cleaning fluid to the reservoir, and in some embodiments, a means to drain cleaning fluid from the reservoir 364. For example, the tub 104 may include a removable access panel 124 that provides access to the reservoir 364 filler and/or reservoir 364 drain. The cleaning fluid may be any known cleaning fluid suitable for in-tub use when water is drained from the tub and without harming the materials used within the tub 104 and below the platform 108.

The cleaning fluid reservoir 364 is coupled to a mixer 368 that adjusts a concentration of the cleaning fluid distributed to a pump 372 and/or selects between the cleaning fluid (for wash cycles) and water (for rinse cycles). In one embodiment, the mixer 368 may receive only a hot water input or a cold water input. In another embodiment, the mixer 368 may receive both a hot water and a cold water input. In one embodiment, a water temperature to the pump 372 may be manually adjustable by a manual setting on the mixer 368. In another embodiment, the water temperature to the pump 372 may be automatically adjustable to a predetermined water temperature by a setting in a user interface in a control panel or other user device, as discussed herein. The user may adjust the wash and rinse water temperatures from all cold water to all hot water and all temperatures between those points. In one embodiment, the mixer 368 may be accessed through the access panel 124 for maintenance purposes or to manually adjust a water temperature setting or a concentration mixture.

In one embodiment, the mixer 368 may include temperature sensors (not shown) that provide inlet hot water and cold water temperatures to the controller 804. In one embodiment, a temperature sensor associated with the cleaning fluid reservoir 364 may also provide a cleaning fluid temperature to the controller 804. In one embodiment, the mixer 368 output to the pump 372 may also have a temperature sensor that provides a mixer 368 output temperature to the controller 804.

The output of the mixer 368 is routed to a pump 372 that distributes a selected cleaning fluid, cleaning fluid/water mixture, or water to the tub. In one embodiment, the pump 372 may be a fixed speed pump. In another embodiment, the pump 372 may be a variable-speed pump. In another embodiment, the pump 372 may support multiple fixed operating speeds. The pump 372 may be an AC-powered or a DC-powered pump. The pump 372 (or a pump controller, not shown) may receive an on/off control and/or an operating speed control from a pump controller or a user interface in a control panel or other user device, as discussed herein. For example, a variable speed or multiple fixed speed pump 372 may be preferred by utilizing a higher-pressure wash cycle and a lower pressure rinse cycle.

The pump 372 output may be distributed through a network of conduits to various jets in the sides or ends of the tub 104. FIG. 3B illustrates a cleaning solution conduit 360 (which also routes water for rinsing, etc) routed to a group of upper side jets 356 and lower side jets 352. Although not shown, a number of upper side jets 356 and/or lower side jets 352 may be present in the vertical end surfaces of the tub 104. This may beneficially provide more sprayers to clean all tub 104 and lift 408 surfaces on all sides. Although upper 356 and lower 352 jets are shown, any number or arrangement of jets or sprayers may be supported.

Figure 4:
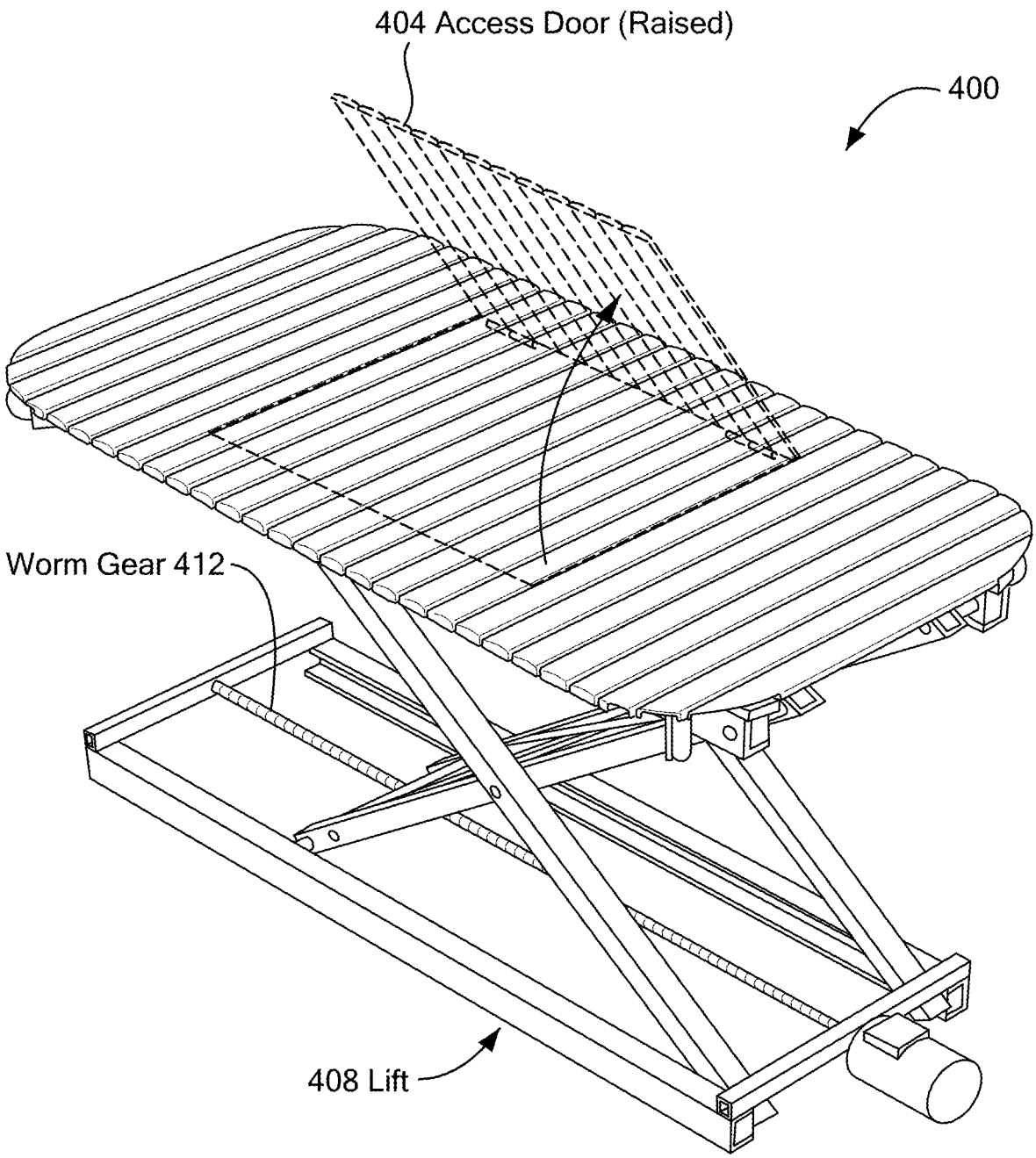
FIG. 4 schematically shows a perspective view of a lift in accordance with illustrative embodiments of the invention.

FIG. 4 schematically shows a perspective view of a lift and platform 400 in accordance with illustrative embodiments of the invention. FIG. 4 leaves out the tub 104 to illustrate exemplary elements of the lift 408 more clearly. The lift and platform 400 may include the platform 108 coupled to top surfaces of a lift 408. In illustrative embodiments, the lift 408 may be implemented as a scissors lift that keeps the platform 108 level as the platform 108 is raised or lowered. In some embodiments, the lift 408 may be removable from the tub 104. The actuator 332 may drive a worm gear 412 through a threaded fitting to cause the platform 108 to raise or lower. Details of the illustrated scissors lift 408 are shown and described in greater detail in FIG. 5.

FIG. 4 also illustrates a hinged access door 404 while the platform 108 is in a raised position. The access door 312 may be movable about its hinge at any of a variety of different positions of the platform 108 within the well 304. In another embodiment, the access door 312 may be removable from the platform 108. The access door 312 allows the user 120 or other individual to clean beneath the platform 108, such as the sides of the well 304 or the bottom surface 308 of the tub 104. The access door 312 may also allow maintenance access to the actuator 332, the lift 408, and/or the drain 316/macerator 328.

Figure 5:
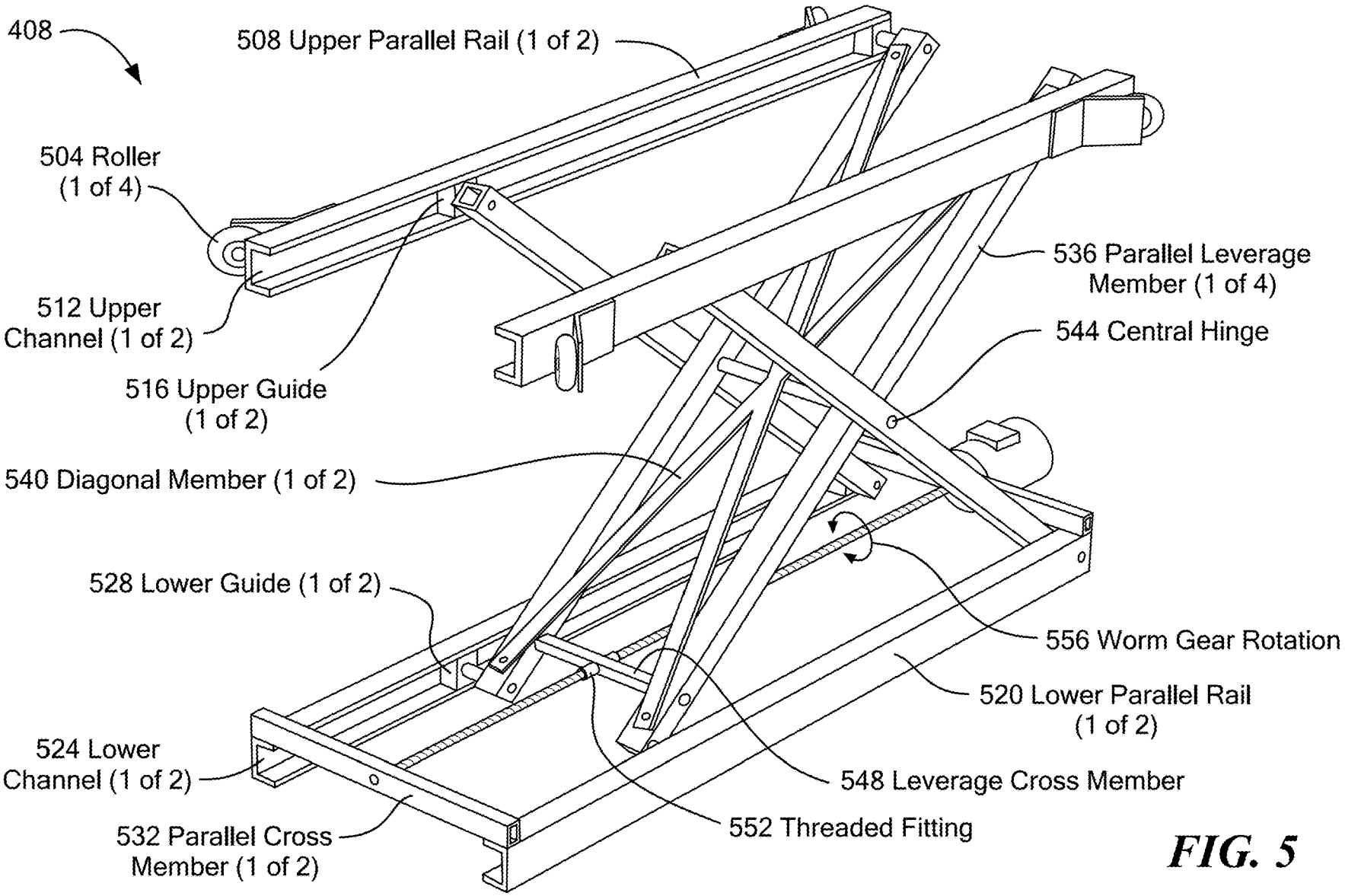
FIG. 5 schematically shows a perspective view of the lift in accordance with illustrative embodiments of the invention.

FIG. 5 schematically shows a perspective view of the lift 408 in accordance with illustrative embodiments of the invention. The lift 408 may be any suitable lift technology, including a scissors lift, a telescoping lift, a hydraulic lift, or a traction lift. FIG. 5 illustrates possible components and features of a scissors lift embodiment. Other embodiments with different features may be realized. The platform 108 has been removed from FIG. 5 to more clearly show principal components and features of the lift 408.

The lift 408 includes a base configured to rest upon the bottom surface 308 of the tub 104. The base may include lower parallel rails 520, which may include slip-resistant feet or pads to prevent slipping on the bottom surface 308. In one embodiment, the lower parallel rails 520 may be rigidly fastened to the bottom surface 308 of the tub 104. In some embodiments, the base may be configured to fit into the well 304 such that there is a minimal gap between the base and the well 304. In one embodiment, the lift 408 may be secured to the tub 104 at the drive shaft feedthrough 336 to the actuator 332. Indeed, the lift 408 may be secured to the tub 104 at any of a number of other locations as well.

The lower parallel rails 520 may include lower channels 524 to allow lower guides 528 to slide lengthwise within. Rigidity of the lower parallel rails 520 may be provided through parallel cross members 532. In illustrative embodiments, one parallel cross member 532 (closest to the actuator 332) may include a hole for the worm gear 412 to pass through. Another parallel cross member 532 (at opposite end of the lower parallel rails 520 from the actuator 332) may include a coupling that retains an end of the worm gear 412 while allowing the worm gear 412 to freely rotate in either direction.

The lift 408 may include upper parallel rails 508 fastened to a bottom surface of the platform 108. The upper parallel rails 508 may include upper channels 512 to allow upper guides 516 to lengthwise slide within. The scissors lift is configured such that the upper guides 516 slide in concert with the lower guides 528.

The upper 516 and lower 528 guides may be made from any suitable material, including polymers, wood, metal, ceramic, stone, or glass. In preferred embodiments, the upper 516 and lower 528 guides are made from a low coefficient of friction material to facilitate travel within the upper channels 512 and the lower channels 524, respectively.

The upper parallel rails 508 may be coupled to the lower parallel rails 520 by a group of parallel leverage members 536. In illustrative embodiments, there are four parallel leverage members 536.

One pair of parallel leverage members 536 may be coupled to an end of the lower parallel rails 520 at the bottom and to the upper guides 516 at the upper end. The coupling at the lower end allows rotation around an axle (e.g., screw or other fastener), but no lengthwise movement relative to the lower parallel rails 520. The coupling to the upper guides 516 at the upper end allows lengthwise movement relative to the upper parallel rails 508.

Another pair of parallel leverage members 536 is coupled to an end of the lower parallel rails 520 at the top and to the lower guides 528 at the bottom end. The coupling at the upper end allows rotation around an axle (e.g., screw or other fastener) but no lengthwise movement relative to the upper parallel rails 508. The coupling to the lower guides 528 at the lower end allows lengthwise movement relative to the lower parallel rails 520. In illustrative embodiments, a pair of diagonal members 540 provide structural integrity between the pair of parallel leverage members 536 that are fastened to the leverage cross member 548. A leverage cross member 548 between the other pair of leverage members 536 is axially coupled to each of the other pair of leverage members 536 by a screw or other type of fastener that allows free rotation in either direction. A threaded fitting 552 may be generally centrally disposed in the leverage cross member 548. The worm gear 412 passes through the threaded fitting and threads of the worm gear 412 engage threads within the threaded fitting 552. The actuator 332 causes worm gear rotation 556 that moves the leverage cross member 548 and threaded fitting 552 relative to the actuator 332.

For example, when the actuator 332 rotates the worm gear 412 in a clockwise direction, the leverage cross member 548 may move away from the actuator 332, causing the upper 516 and lower 528 guides to move toward the distal (relative to the actuator 332) parallel cross member 532 and thereby lower the upper parallel rails 508 (and thereby the platform 108 coupled to the upper parallel rails 508). Correspondingly, when the actuator 332 rotates the worm gear 412 in a counterclockwise direction, the leverage cross member 548 may move toward the actuator 332, causing the upper 516 and lower 528 guides to move away from the distal parallel cross member 532 and thereby raise the upper parallel rails 508 (and thereby the platform 108 coupled to the upper parallel rails 508).

Ends of the upper parallel rails 508 may be coupled to corresponding rollers 504, which are configured to travel vertically along the inside walls of the well 304. The rollers 504 allow for steady and smooth lifting and lowering motion of the platform 108 by reducing or eliminating sideways wobble. The rollers 504 may also keep the platform centered within the opening in the top surface 116 that the platform 108 closely fits within, when in the raised position.

Figure 6:
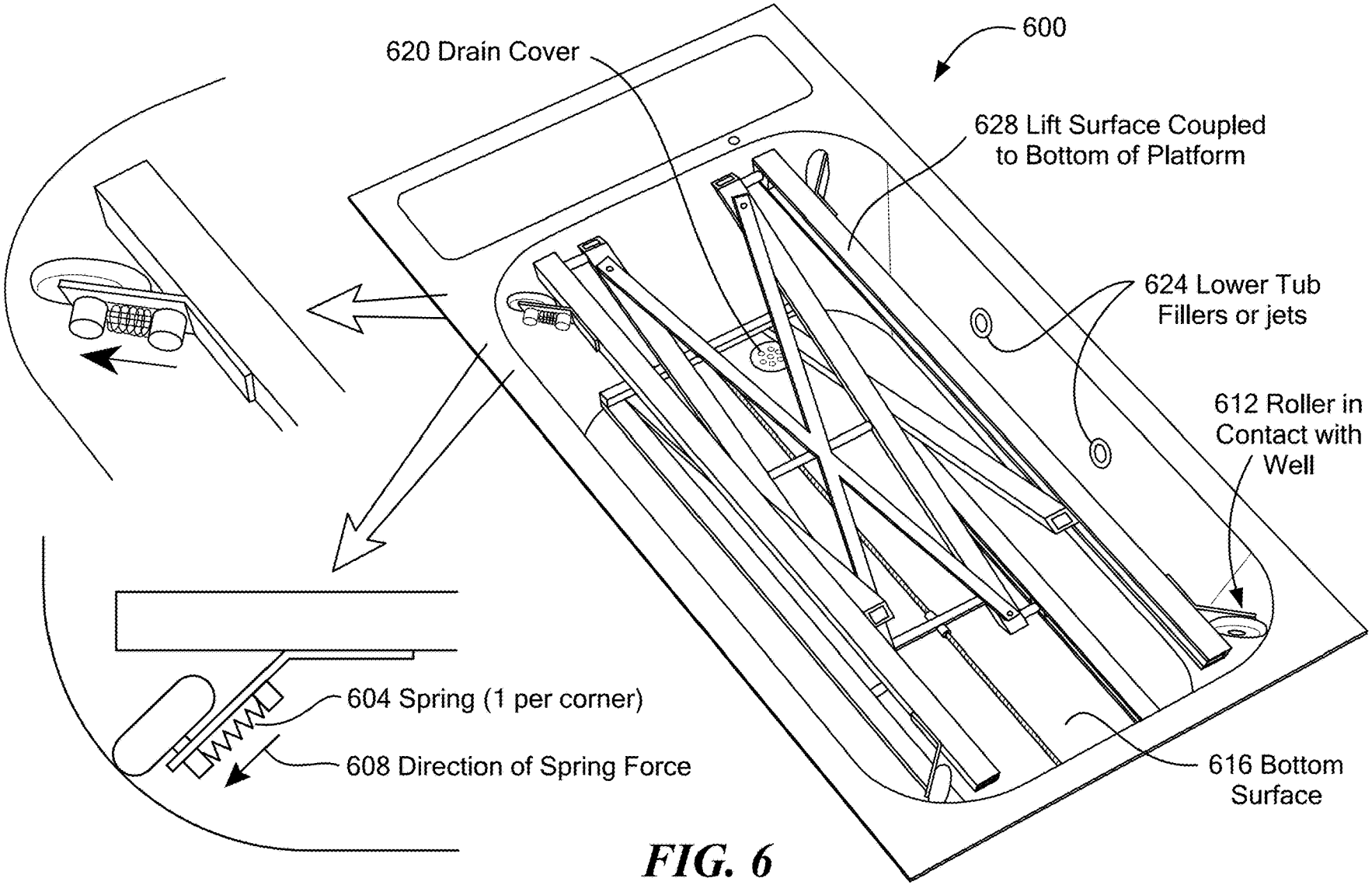
FIG. 6 schematically shows a perspective view of a lift within a tub in accordance with illustrative embodiments of the invention.

FIG. 6 schematically shows a perspective view of a lift 408 within the tub 104 in accordance with illustrative embodiments of the invention. FIG. 6 omits the platform 108 to more clearly illustrate the relationship between the lift 408 and the tub 104.

As explained previously, each corner of the lift 408 has associated vertically oriented rollers 504. Associated with each roller 504 may be a spring 604 in compression, which in illustrative embodiments is configured to provide outward force 608 to the rollers 504 to main contact 612 with inside corners of the well 304. In other embodiments, other types of force members may be used to provide outward force to the rollers 504 to maintain contact with the well 304, such as springs in expansion, resilient polymer or rubber blocks, and the like. Springs or other resilient members may beneficially provide a cushioning force to reduce vibration to the platform 108 while the platform 108 is being raised or lowered.

FIG. 6 illustrates an inside bottom surface 616 of the tub 104 and a drain cover 620 as a cover plate to the macerator 328 and the drain 316. In one embodiment, the drain cover 620 may be removable to facilitate removal of hair and other debris from the drain cover 620. In one embodiment, removal of the drain cover 620 may inhibit operation of the macerator 328 to enhance safety during maintenance operations. For example, a microswitch in the bottom surface 308 of the tub 104 or a top surface of the macerator 328 may interrupt power applied to the macerator 328 when the microswitch is open (i.e., corresponding to the drain cover 620 removed). When the microswitch is closed (i.e., the drain cover 620 in-place), power may be routed to the macerator 328, allowing operation.

With the platform 108 removed for illustrative purposes, lift surfaces 628 in contact with the bottom of the platform 108 are shown. In the example of a scissors-type lift shown in FIG. 5, the lift surfaces 628 may be top surfaces of the upper parallel rails 508. In one embodiment, the well 304 may include any number of lower tub fillers or jets 624. For example, the accessible bath may include fillers 624 in addition to or instead of the upper tub filler 144 shown in FIGS. 1-3. They may fill the tub 104 to a desired water depth and temperature as required by the user 120. Where the lower tub jets 624 are present, the tub 104 may include a water return path (not shown) that is separate from the drain 316 and drain cover 620. The water return path may provide water already in the tub 104 to impellers or other actuators that produce water pressure to the jets 624, as well understood with respect to spa operation. In one embodiment, the fillers or jets 624 to operate the spa may be different than the upper 356 and lower 352 side jets for the cleaning system. For example, the spa jets 624 may be jets suitable for a whirlpool while the cleaning system jets 356/352 may be higher pressure jets suitable for cleaning maintenance operations when the tub 104 is otherwise empty of water.

Figure 7A:
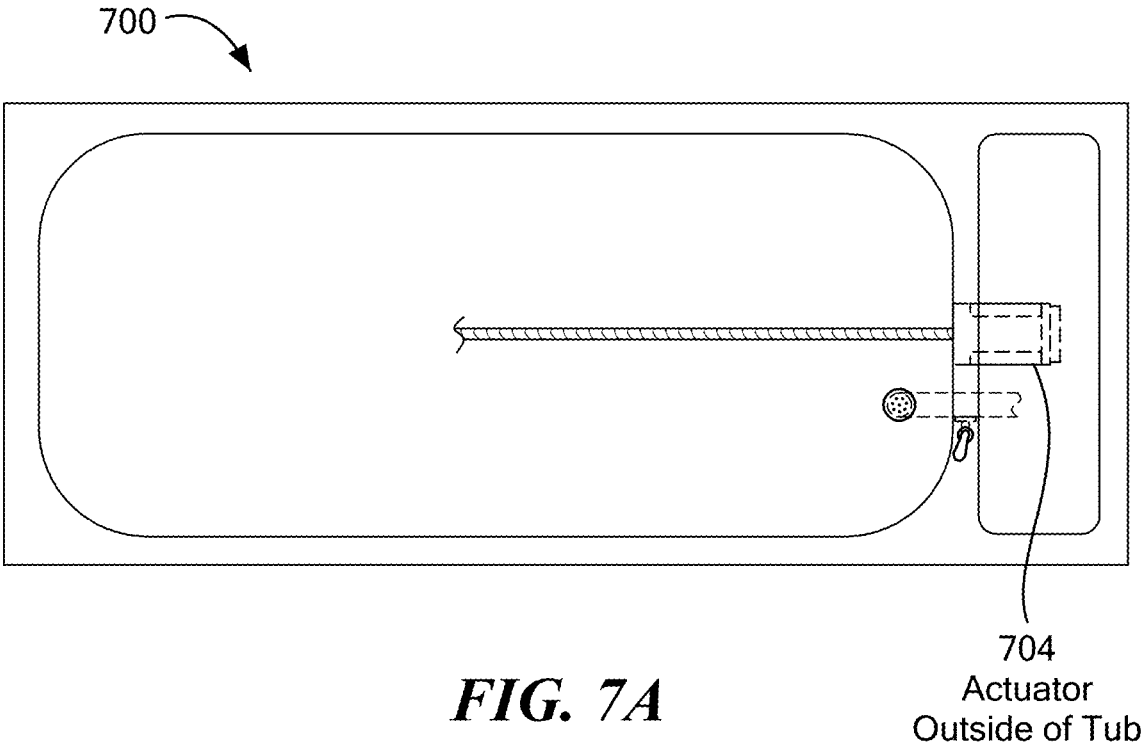
FIG. 7A schematically shows an overhead view of the accessible bath with an external actuator in accordance with illustrative embodiments of the invention.

FIG. 7A schematically shows an overhead view 700 of the accessible bath 100 with an external actuator 704 in accordance with illustrative embodiments of the invention. The actuator 704 may be mounted outside the tub 104, which may beneficially allow for a wider range of power sources to the actuator 704 while meeting safety regulations. However, maintenance access to the actuator 704 may not be performed through the access door 312 and may require use of the access panel 124 or another access method.

Figure 7B:
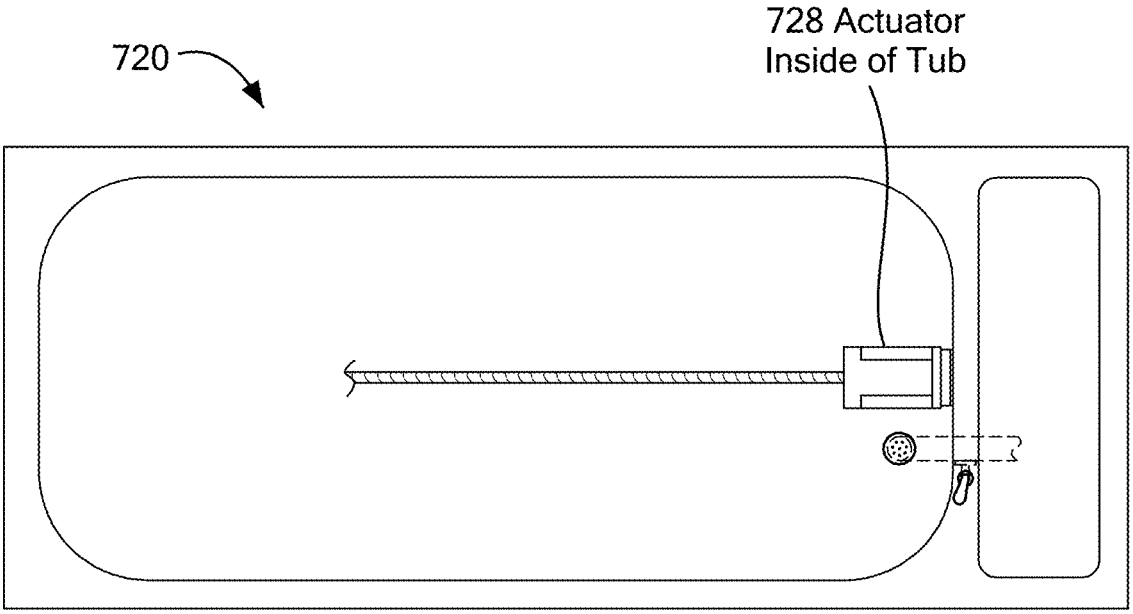
FIG. 7B schematically shows an overhead view of the accessible bath with an internal actuator in accordance with illustrative embodiments of the invention.

FIG. 7B schematically shows an overhead view 720 of the accessible bath 100 with an internal actuator 728 in accordance with illustrative embodiments of the invention. The actuator 728 may be mounted inside the tub 104, as shown herein. Because the actuator 728 will be submerged in water when the tub 104 is filled, a limited number of power sources to the actuator 728 may be required, such as low voltage DC power. However, maintenance access to the actuator 728 may be performed through the access door 312, and the drive shaft feedthrough 336 in the side of the tub 104 may not be required since the actuator 728 and the worm gear 412 are completely within the tub 104.

Figure 7C:
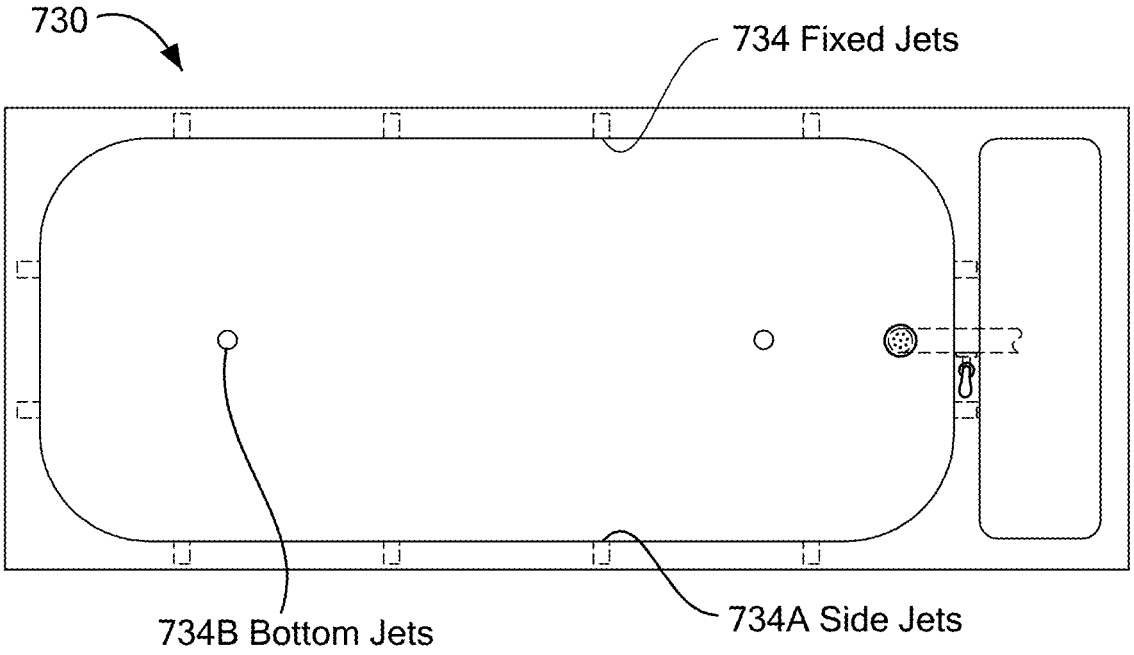
FIG. 7C schematically shows an overhead view of the accessible bath cleaning system with fixed jets in accordance with illustrative embodiments of the invention.

FIG. 7C schematically shows an overhead view 730 of the accessible bath cleaning system with fixed jets in accordance with illustrative embodiments of the invention. Illustrated are various fixed jets 734, including side jets 734A and bottom jets 734B. Fixed jets 734 are only able to spray cleaning solution in a single direction, although in some embodiments that direction may be manually selected. For example, the fixed jets 734 may be mounted in a ball gimbal with a range of left-right, up-down, and angled directions. Preferably, the fixed jets 734 are distributed in the tub 104 with a spacing that allows full internal coverage without missed areas, taking into account the directional flexibility in the jets 734. The cleaning system jets are intended to be used after the tub 104 has been drained of water and the platform is raised to a top position. It should be understood that recessed or flush fixed jets 734 may be preferable to void interference with the platform 108 as it lowers.

Figure 7D:
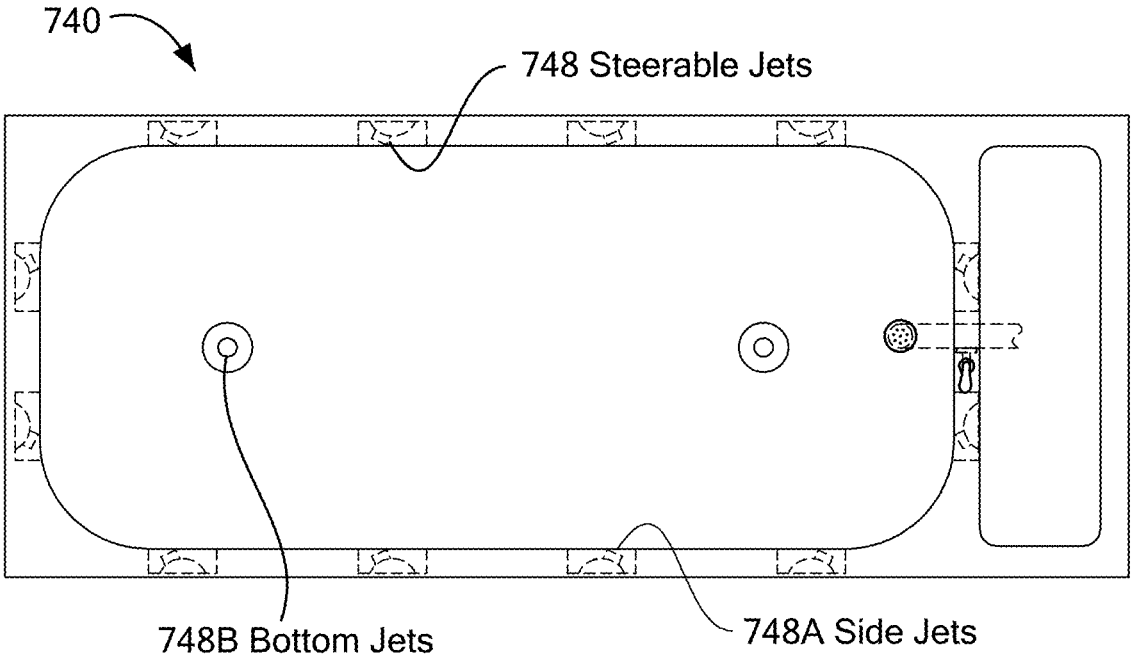
FIG. 7D schematically shows an overhead view of the accessible bath cleaning system with steerable jets in accordance with illustrative embodiments of the invention.

FIG. 7D schematically shows an overhead view 740 of the accessible bath cleaning system with steerable jets in accordance with illustrative embodiments of the invention. Illustrated are various steerable jets 748, including side jets 748A and bottom jets 748B. Steerable jets 748 may independently movable/rotatable under water pressure to spray the cleaning solution and water throughout the tub 104 below the platform 108. In another embodiment, the steerable jets 748 may be movable/rotatable by a motor or other actuator associated with each steerable jet 748. In one embodiment, each steerable jet 748 moves/rotates independently from all other steerable jets 748. In another embodiment, steerable jets 748 may be synchronized to point in generally parallel directions to avoid interference between different steerable jets 748. The synchronization may be provided by one or more unique signals from the controller 804 (not shown) or provided between actuators of the steerable jets 748 (not shown). The cleaning system jets are intended to be used after the tub 104 has been drained of water and the platform is raised to a top position. it should be understood that recessed or flush steerable jets 748 may be preferable to void interference with the platform 108 as it lowers.

Figure 8A:
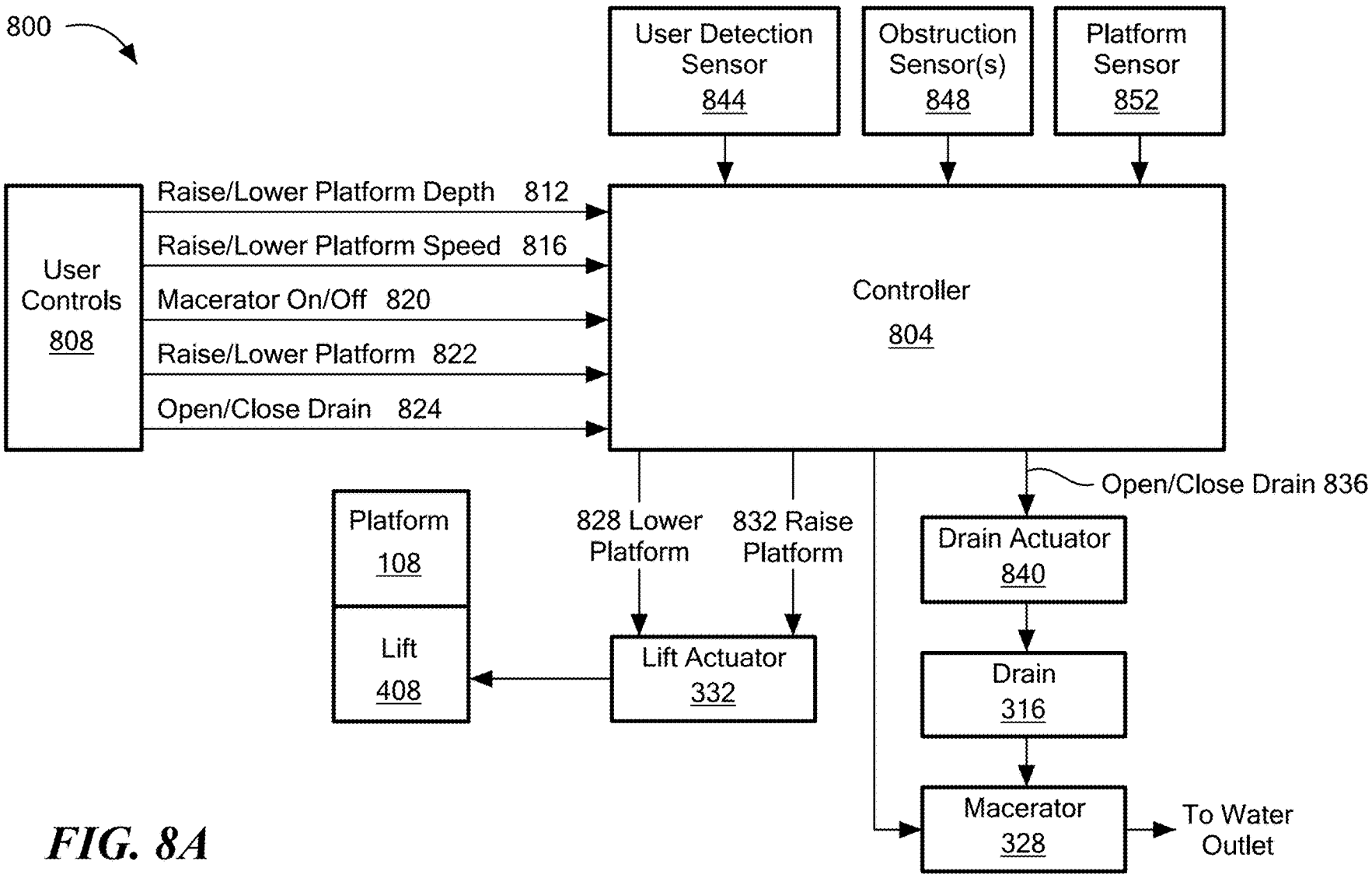
FIG. 8A shows a block diagram of control aspects of the accessible bath in accordance with illustrative embodiments of the invention.

FIG. 8A shows a block diagram 800 of control aspects of the accessible bath 100 in accordance with illustrative embodiments of the invention. FIG. 8A illustrates various features of the accessible bath 100 and is an example of a representative control block diagram. Specific embodiments may include fewer or more controlled features, and in some embodiments all or most control features may be manually actuated by the user 120 or other individual.

It should be noted that FIG. 8A only schematically shows each of these control aspects. Those skilled in the art should understand that each of these components can be implemented in a variety of conventional manners, such as by using hardware, software, or a combination of hardware and software, across one or more other functional components. For example, the controller 804 (discussed in detail below) may be implemented using a plurality of microprocessors executing firmware. As another example, the controller 804 may be implemented using one or more application specific integrated circuits (i.e., "ASICs") and related software, or a combination of ASICs, discrete electronic components (e.g., transistors), and microprocessors. Accordingly, the representation of the controller 804 and other components in a single box of FIG. 8A is for simplicity purposes only. In fact, in some embodiments, the controller 804 (or other components) of FIG. 8A may be distributed across a plurality of different machines—not necessarily within the same housing or chassis.

It should be reiterated that the representation of FIG. 8A is a simplified representation of an actual accessible bath 100. Those skilled in the art should understand that such a device has many other physical and functional components. Accordingly, this discussion is not intended to suggest that FIG. 8A represents all the elements of the tub 104 and system 800.

As shown, in one embodiment, the accessible bath 100 includes the above noted controller 804. As known in the art, the controller 804 may include a processor, one or more memory devices, a user display device, a network connection, and/or may execute stored programs or applications. The controller 804 in such a form may be software-upgradeable to modify stored programs or applications and change system functionality. For example, a user 120 interacting with the system 800 may approve an available software update that allows user 120 profiles for multiple users to be programmed and stored in the memory devices rather than just for a single user. In another embodiment, the controller 804 may include manual switches, relays, indicators, or other components and not be programmable or software upgradable.

In one embodiment, the accessible bath may include user controls 808. Among other things, the user controls 808 may provide selection inputs to the controller 804 to direct operation of the accessible bath, and in some embodiments provide feedback to the user 120 (e.g., indicator lights/legends, display, touchscreen, speaker, etc.) of the operating state of the accessible bath, error conditions, available options, and the like. User controls 808 may accept a touch selection on a touchscreen or control buttons, a verbal command, or detect a predetermined user 120 facial or hand gesture with a camera and associated image recognition software application (not shown). The user controls 808 may be mounted proximate to the user 120, such as on a wall adjacent to the accessible bath. In one embodiment, the user controls 808 may be implemented as a smartphone or other computing device (e.g., smartwatch, wearable computer, etc.) application. User controls 808 may include an open/close drain selection 824, a raise/lower platform selection 822, a macerator on/off selection 820, a raise/lower platform speed selection 816, and/or a raise/lower platform depth selection 812.

The open/close drain selection 824 may cause the controller 804 to generate a corresponding open/close drain control 836 to a drain actuator 840. The drain actuator 840 may be a solenoid or other form of actuator that opens or closes the drain 316 based on the state of the open/close drain control 836.

The raise/lower platform selection 822 causes the controller 804 to initiate raising or lowering the platform 108 from the platform's present location (i.e., raised or lowered). In response to a raise platform selection 822, the controller 804 generates a raise platform control 832 to the lift actuator 332, and the lift actuator 332 causes the lift 408 to raise the platform 108. In response to a lower platform selection 822, the controller 804 generates a lower platform control 828 to the lift actuator 332, and the lift actuator 332 causes the lift 408 to lower the platform 108.

The macerator on/off selection 820 controls the operation of the macerator 328. In one embodiment, when the macerator on/off selection reflects an "off" state, the controller 804 may disable the macerator 328 from operating, regardless of water flow through the drain 316. When the macerator on/off selection reflects an "on" state, the controller 804 may enable the macerator 328, which may run when water is flowing through the drain 316.

The raise/lower platform speed selection 816 designates a speed at which the platform 108 is raised or lowered. In one embodiment, multiple speeds may be selected by user controls 808 (e.g., 2 inches/second, 3 inches/second, 4 inches/second, or 5 inches/second). In another embodiment, the user 120 may specify a raising/lower speed on the user controls (e.g., 2.5 inches/second). The controller 804 may convert the received selection 816 into a discrete voltage or other means applied to the lower platform 828 and the raise platform 832 controls to the lift actuator 332.

The raise/lower platform depth selection 812 designates how deep within the well 304 the platform 108 descends. In one embodiment, the selections may represent discrete amounts or percentages (e.g., 25%, 50%, 75%, or 100%). In another embodiment, the user 120 may enter a discrete platform depth selection (e.g., 45%) on the user controls 808. In another embodiment, the user 120 may specify a desired platform depth 812 based on the seated user 120 (e.g., "ankle depth", "waist depth", "chest depth", "shoulder depth", etc.). In one embodiment, the controller 804 may convert the received raise/lower platform depth selection 812 into a time duration the lower platform 828 or raise platform 832 controls are activated. Some embodiments may save user preferred selections of the controls.

In one embodiment, the system 800 may include a user detection sensor 844. The user detection sensor 844 detects a seated user on the platform 108 to the controller 804. If the controller 804 does not receive an indication of a seated user 120 from the user detection sensor 844, the controller 804 may inhibit the lower platform 828 and the raise platform 832 controls until a seated user 120 is detected. Inclusion of a user detection sensor 844 may improve accessible bath safety by reducing the chance of a fall by the user 120 on a moving platform 108. The user detection sensor 844 may include one or more switches or optical sensors associated with the platform 108, a seat on the platform 108, or a wheelchair 156 (e.g., using a wireless transmitter to the controller 804). The user detection sensor 844 may also include one or more cameras that provide images to a user image detection software application that executes on the controller 804. The user image detection software may provide an indication to the controller 804 when the user 120 is seated or not seated on the platform 108. In one embodiment, the user detection sensor 844 may include a scale that measures a weight of the user 120 on the platform. The controller 804 may report the weight to the user through a display associated with user controls 808 and/or audibly through a speaker.

In one embodiment, the system 800 may include one or more obstruction sensors 848 that cause the controller 804 to inhibit the lower platform 828 and raise platform 832 controls to the lift actuator 332. For example, obstruction sensors 848 may detect when a foot of the user 120 is extending off the platform 108 when the platform 108 is being raised. This may prevent an injury if the foot is caught between the platform 108 and the top surface 116 of the tub 104. Other obstruction sensors 848 may be associated with various components of the lift 408 to prevent damage to the lift actuator 332 if the lift 408 is jammed or obstructed. In one embodiment, the controller 804 may reverse raising/lowering of the platform 108 either partially or fully if an indication from an obstruction sensor 848 is received.

The system 800 may include a platform sensor 852, which is configured to provide an indication to the controller 804 when a raising platform 108 becomes level with the top surface 116 of the tub 104. A flush and coplanar relationship between the platform 108 and the top surface 116 of the tub may improve safety by eliminating a lip that a user 120 may trip over. It also optimizes the ease of rolling a wheelchair 156 on or off the platform 108. In one embodiment, the platform sensor 852 may be associated with either the platform 108 or the tub 104 and may include a switch, an optical sensor, a camera, or any other type of sensor.

Figure 8B:
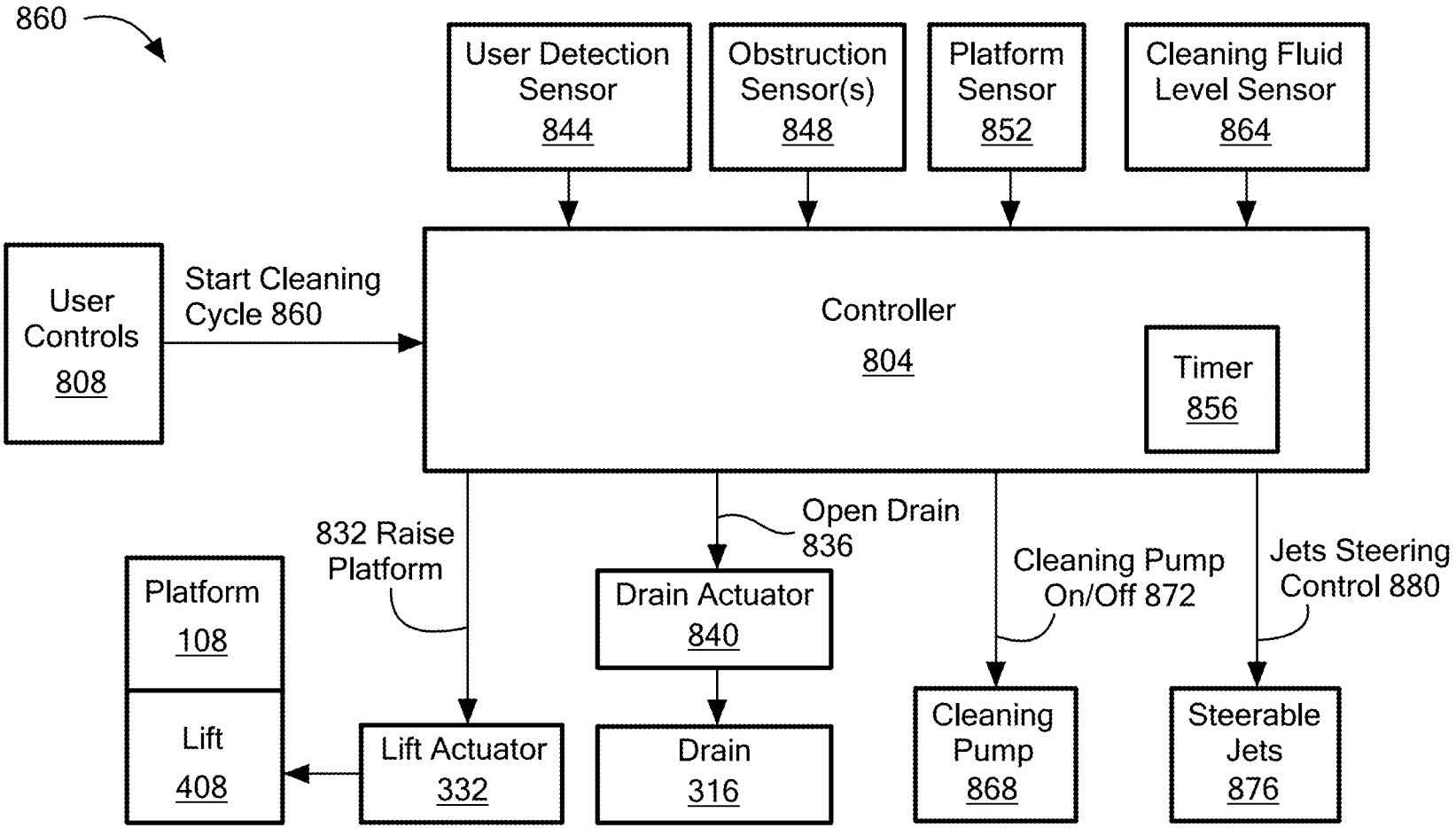
FIG. 8B shows a block diagram of control aspects of a cleaning system for the accessible bath in accordance with illustrative embodiments of the invention.

FIG. 8B shows a block diagram of control aspects of a cleaning system for the accessible bath in accordance with illustrative embodiments of the invention. The cleaning system may share many common components with the control system 800 illustrated in FIG. 8A, including the controller 804, the platform controls 332/832, and the drain controls 316/840/836.

The user controls 808 may transfer a start cleaning cycle signal to the controller 804. This causes the controller 804 to take several pre-cleaning actions prior to initiating the actual cleaning cycle.

In response to receiving the start cleaning cycle command 860, the controller 804 may first read the obstruction sensor (s) 848 to make sure the platform 108 is not encumbered or unable to move. If the obstruction sensor(s) 848 do not indicate a current obstruction, the controller 804 reads the platform sensor 852 to determine if the platform 108 is in the fully raised position or lowered some distance. If the platform 108 is lowered some distance, the controller 804 transmits a raise platform command 832 to the lift actuator 332, which raises the platform 108 to the fully raised position and verifies with the platform sensor 852. Next, the controller 804 determines if a user is on the platform 108 by reading the user detection sensor 844. If a user is on the platform 108, the controller 804 may transmit a notification (not shown) to a speaker or other user interface (possibly as part of the user controls 808) requesting the user to leave the platform before the cleaning cycle can begin. Once the controller 804 observes the user detection sensor 844 is not active (meaning no user is on the platform 108), the controller 804 may initiate an initial wash cycle. The controller 804 may administer a fixed number of wash and/or rinse cycles, including a single wash and rinse cycle. In one embodiment, the number of wash and rinse cycles may be user-programmable via a wash/rinse cycle count command from the user controls 808 (not shown).

Next, the controller 804 ensures the drain 316 is open by transmitting an open drain 836 command to the drain actuator 840, which then opens the drain. If a drain actuator is not present, the controller 804 may transmit a notification (not shown) to a speaker or other user interface (possibly as part of the user controls 808) requesting the user to manually open the drain control 324.

Before initiating an initial rinse cycle, the controller 804 may read a cleaning fluid level sensor 864 associated with the cleaning fluid reservoir 364. If the cleaning fluid level sensor 864 indicates an insufficient cleaning fluid level in the cleaning fluid reservoir 364, the controller 804 may transmit a notification (not shown) to a speaker or other user interface (possibly as part of the user controls 808) requesting the user to add cleaning fluid to the cleaning fluid reservoir 364 before the cleaning cycle can begin. Once the controller 804 verifies a proper amount of cleaning fluid from the cleaning fluid level sensor 864, the controller 805 finally initiates the initial wash cycle.

The controller 804 next initiates the wash cycle by loading the wash time parameter into a timer 856 associated with the controller 804. The timer 856 may be hardware circuit within a microprocessor or microcontroller or mechanized by software instructions executed within the controller 804. The controller controls a cleaning pump on/off command 872 to the cleaning pump 868 based on the timer 856 status and terminates the cleaning pump on/off command 872 when the timer 856 expires. If the cleaning system includes steerable jets 876 that are steered under controller 804 direction (instead of either fixed jets 734 or steerable jets 748 that are steered by water pressure without controller 804 involvement), the controller 804 may transmit jets steering control commands 880 to the steerable jets 876 during the cleaning cycle.

The controller 804 may next initiate another wash cycle and repeat the previous steps or initiate a delay cycle. The delay cycle pauses the cleaning pump 868 and the steerable jets 876 for a period of time to allow the cleaning fluid time to act on the tub 104, the lift 408, and other components to remove dirt, soap film, and other contamination. The delay cycle may require a delay time to be loaded into the timer 856.

When the delay time has expired, the controller 804 may initiate one or more rinse cycles. If multiple rinse cycles are desired, the rinse cycles hay have different durations, different water temperatures, and/or different pump 868 pressures. The rinse time(s) may require one or more rinse times to be loaded into the timer 856.

Once the final rinse cycle has been completed, the controller 804 may transmit a notification (not shown) to a speaker or other user interface (possibly as part of the user controls 808) notifying the user the cleaning cycle has completed and the system is available for use.

In one embodiment, the user controls 808 may transfer an adjust cleaning temperatures command (not shown) to the controller 804. The adjust cleaning temperatures command may specify one or more of a target wash temperature, a target rinse temperature, a wash temperature decrease/increase (wash temperature delta) below/over a current wash temperature, or a rinse temperature decrease/increase (rinse temperature delta) below/over a current rinse temperature. The adjust cleaning temperatures command adjusts the wash cycle temperature or the rinse cycle temperature, which may be the same as or different than the wash cycle temperature. This may cause the controller 804 to transfer one or more commands to the mixer 368 or one or more actuators associated with hot and cold water inlets to the mixer 368, based on received temperature sensor inputs as described with reference to FIG. 3B.

In one embodiment, the user controls 808 may transfer a change cleaning cycle timing command (not shown) to the controller 804. The change cleaning cycle command may specify one or more of a wash cycle time period, a rinse cycle time period, a delay time between the wash cycle and the rinse cycle, a wash time decrease/increase (wash time delta) below/over a current wash time, or a rinse time decrease/increase (rinse time delta) below/over a current rinse time. The controller adjusts the timer 856 using the change parameters specified in the change cleaning cycle timing command.

In one embodiment, the user controls 808 may transfer a change pump velocity command (not shown) to the controller 804. The pump 372 may be a variable speed pump or a pump that supports different operating speeds (e.g., off, low, medium, or high). The change pump velocity command may specify a new pump velocity for a wash cycle and/or a rinse cycle or a pump velocity decrease/increase (wash pump velocity delta) below/over a current wash cycle pump velocity, or a pump velocity decrease/increase (rinse pump velocity delta) below/over a current rinse cycle pump velocity.

Figure 9A:
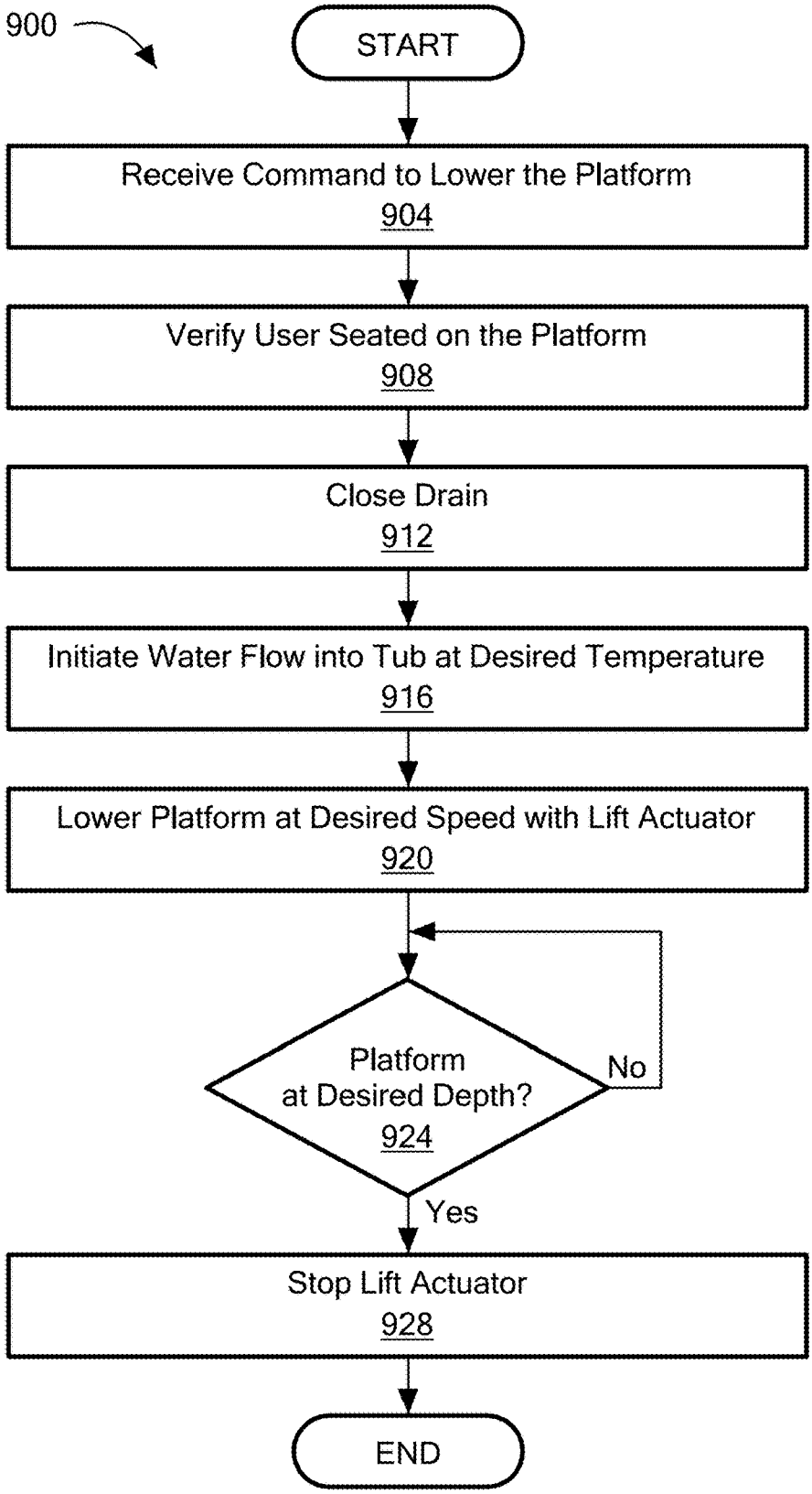
FIG. 9A shows a flowchart of a platform lowering process in accordance with illustrative embodiments of the invention.

FIG. 9A shows a flowchart of a platform lowering process 900 in accordance with illustrative embodiments of the invention. It should be noted that some of the steps may be performed in a different order than that shown, or at the same time. Those skilled in the art therefore can modify the process as appropriate.

The process begins at block 904, in which the controller 804 may receive a command to lower the platform 822. The command 822 may be received in conjunction with a raise/lower platform depth selection 812 and/or a raise/lower platform speed selection 816. Flow proceeds to block 908.

At block 908, the controller 804 may verify a user 120 is seated on the platform 108. In one embodiment, the controller 804 may receive an indication from a user detection sensor 844, as described herein. Flow proceeds to block 912.

At block 912, the controller 804, the user 120, or another individual may close the drain 316. In one embodiment, the controller 804 may visually or audibly present a request to the user 120 or other individual to close the drain 316, and the user 120 or other individual may manually close the drain 316 using the drain control 324. In another embodiment, the controller 804 may close the drain 316 using the open/close drain control 836 and drain actuator 840, as discussed herein. Flow proceeds to block 916.

At block 916, water flow is initiated into the tub 104 at a desired temperature. In one embodiment, the user 120 or other individual may manually operate one or more bath controls 140. In another embodiment, the controller 804 may control one or more water control actuators (not shown) to add water to the tub 104 under verbal or water selection controls from the user controls 808. Flow proceeds to block 920.

At block 920, the controller 804 lowers the platform 108 at a desired speed with the lift actuator 332. The user controls 808 may provide a raise/lower platform depth selection 812, a raise/lower platform speed selection 816, and a raise/lower platform selection 822 to the controller 804. In another embodiment, the user 120 or other individual may operate one or more manual controls to lower the platform at a desired speed and depth. Flow proceeds to decision block 924.

At decision block 924, the controller 804 may determine if the platform 108 has been lowered to a desired depth. In one embodiment, the raise/lower platform depth selection 812 may specify the depth that the platform 108 is to be lowered to. In another embodiment, the user 120 or other individual may use manual controls to stop the platform 108 at a desired depth. If the platform 108 has not reached the desired depth, then flow proceeds to decision block 924 to continue lowering until the desired depth has been reached. If the platform 108 has reached the desired depth, then flow proceeds to block 928.

At block 928, the controller 804, the user 120, or other individual may stop the lift actuator 332. In controller 804 embodiments, the controller 804 may inhibit or disable the lower platform control 828 to the lift actuator 332. In manual environments, the user 120 or other individual may use a manual control to inhibit or disable the lift actuator 332. Flow ends at block 928.

Figure 9B:
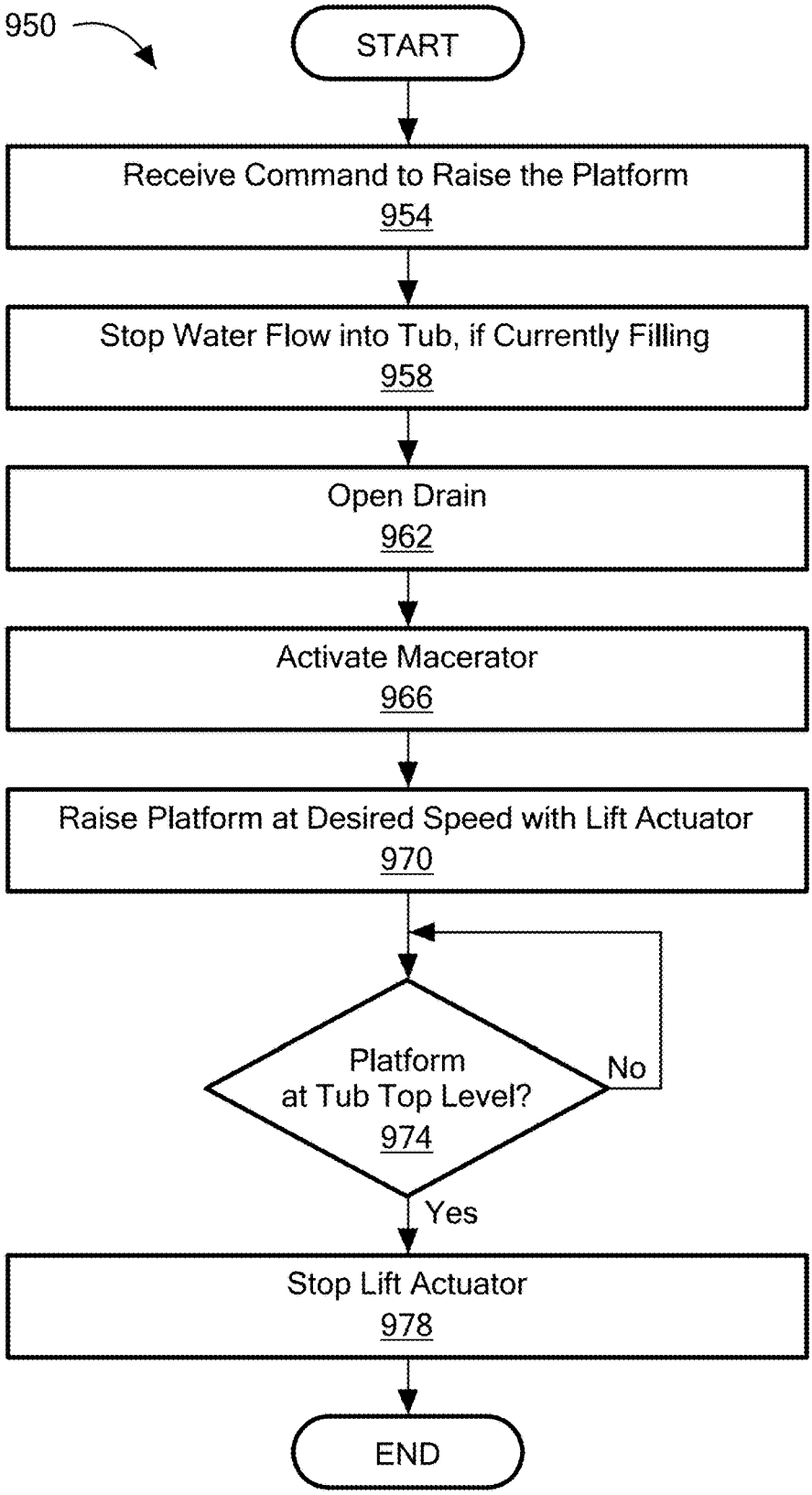
FIG. 9B shows a flowchart of a platform raising process in accordance with illustrative embodiments of the invention.

FIG. 9B shows a flowchart of a platform raising process 950 in accordance with illustrative embodiments of the invention. Flow begins at block 954.

At block 954, the controller 804 may receive a command to raise the platform 822. The command 822 may be received in conjunction with a raise/lower platform depth selection 812 and/or a raise/lower platform speed selection 816. Flow proceeds to block 958.

At block 958, the controller 804 may stop or inhibit water flow into the tub 104 if the tub 104 is currently being filled. In a manual embodiment, the controller 804 may visually or audibly request the user 120 or other individual to turn off the water using shower controls 136 and/or bath controls 140. In an automated embodiment, the controller 804 may control one or more water actuators (not shown) to stop water flow into the tub 104. Flow proceeds to block 962.

At block 962, the controller 804, the user 120, or another individual may open the drain 316. In one embodiment, the controller 804 may visually or audibly present a request to the user 120 or other individual to open the drain 316, and the user 120 or other individual may manually open the drain 316 using a drain control 324. In another embodiment, the controller 804 may open the drain 316 using the open/close drain control 836 and drain actuator 840, as discussed herein. Flow proceeds to block 966.

At block 966, the macerator 328 is activated. In a manual embodiment, the user 120 or other individual may operate a control from the user controls 808 that generates a macerator on/off selection 820 to the controller 804 and the controller activates the macerator 328. The macerator 328 is usable when water is flowing through the drain 316. In an automated embodiment, if the macerator on/off selection 820 reflects an "on" state, the controller 804 may automatically turn on the macerator 328 when water is flowing through the drain 316. Flow proceeds to block 970.

At block 970, the controller 804 raises the platform 108 at a desired speed with the lift actuator 332. The user controls 808 may provide a raise/lower platform depth selection 812, a raise/lower platform speed selection 816, and a raise/lower platform selection 822 to the controller 804. In another embodiment, the user 120 or other individual may operate one or more manual controls to raise the platform 108 at a desired speed and depth. Flow proceeds to decision block 974.

At decision block 974, the controller 804 may determine if the platform 108 has been raised to a top level of the tub 104. In one embodiment, controller 804 may stop the platform in response to the controller 804 receiving an indication from the platform sensor 852 that the platform 108 has reached the top surface 116 of the tub 104. In a manual embodiment, a user 120 or other individual may stop the platform 108 using a manual control. If the platform 108 has not reached the level of the top surface 116, then flow proceeds to decision block 974 to continue raising until the platform is level with the top surface 116. If the platform 108 has reached the level of the top surface 116, then flow proceeds to block 978.

At block 978, the controller 804, the user 120, or other individual may stop the lift actuator 332. In controller 804 embodiments, the controller 804 may inhibit or disable the raise platform control 828 to the lift actuator 332. In manual environments, the user 120 or other individual may use a manual control to inhibit or disable the lift actuator 332. Flow ends at block 978.

Figure 10:
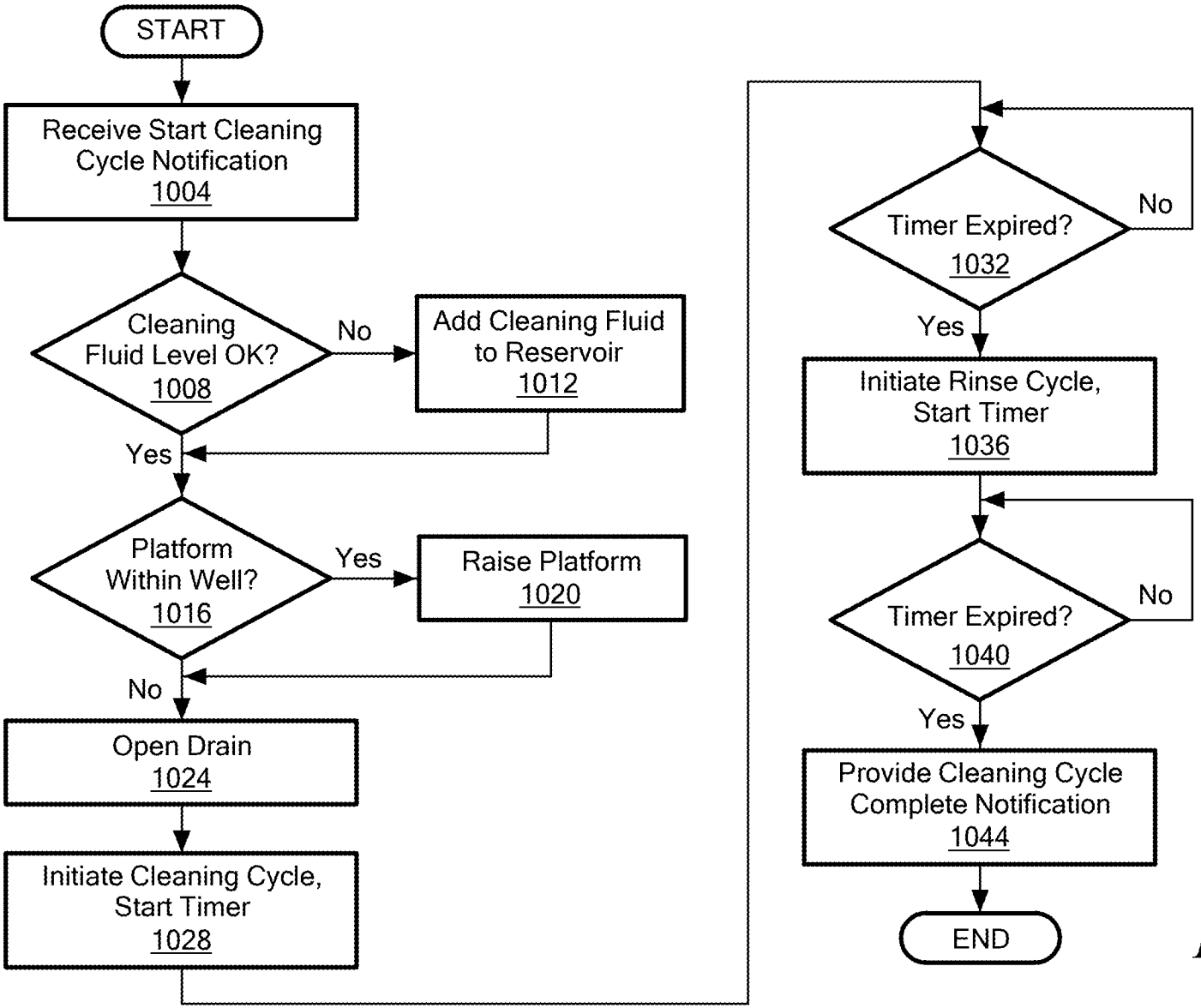
FIG. 10 shows a flowchart of an accessible bath cleaning process in accordance with illustrative embodiments of the invention.

FIG. 10 shows a flowchart of an accessible bath cleaning process in accordance with illustrative embodiments of the invention. Flow begins at block 1004.

At block 1004, the controller 804 receives a start cleaning cycle notification 860. This may be in response to a voice command or other selection on a user interface associated with the accessible spa or the cleaning system, or an application on a user's smartphone or other computing device. Flow proceeds to decision block 1008.

At decision block 1008, the controller 804 determines if the cleaning fluid level in the cleaning fluid reservoir 364 currently stores enough cleaning fluid for the cleaning cycle. If the cleaning fluid reservoir 364 does not store enough cleaning fluid, then flow proceeds to block 1012. If the cleaning fluid reservoir 364 stores enough cleaning fluid, then flow instead proceeds to decision block 1016.

At block 1012, the controller 804 transmits an audible and/or visual notification to the user to add cleaning fluid to the cleaning fluid reservoir 364. The user may temporarily remove the access panel 124 to add cleaning fluid to the cleaning fluid reservoir 324. Flow proceeds to decision block 1016.

At decision block 1016, the controller 804 determines if the platform 108 is within the well 304. If the platform 108 is currently within the well 304, then flow proceeds to block 1020. If the platform 108 is currently raised and not within the well 304, then flow instead proceeds to block 1024.

At block 1020, the controller 804 raises the platform 108 to a fully raised position. Flow proceeds to block 1024.

At block 1024, the controller 804 either opens the drain 316 if the drain 316 is closed or transmits an audible and/or visual notification to the user to manually open the drain 316. At this point, the cleaning cycle is able to begin. Flow proceeds to block 1028.

At block 1028, the controller 804 starts the timer 856 and initiates the cleaning cycle as described in FIG. 8B. Flow proceeds to decision block 1032.

At decision block 1032, the controller 804 checks if the timer 856 has expired. If the timer 856 has not expired, then flow proceeds to decision block 1032 to continue to check for timer 856 expiration. If the timer 856 has expired, then flow instead proceeds to block 1036.

At block 1036, the controller 804 starts the timer 856 and initiates the rinse cycle as described in FIG. 8B. Flow proceeds to decision block 1040.

At decision block 1040, the controller 804 checks if the timer 856 has expired. If the timer 856 has not expired, then flow proceeds to decision block 1040 to continue to check for timer 856 expiration. If the timer 856 has expired, then flow instead proceeds to block 1044.

At block 1044, the cleaning cycle has been completed, and the controller 804 provides a corresponding notification to the user. Flow ends at block 1044.

The process flow described in FIG. 10 is a simplified process flow reflecting a single wash cycle, no delay between the wash cycle and the rinse cycle, and a single rinse cycle. Other important safety checks, such as checking for a user on the platform 108 or obstructions to the platform 108 are not reflected in the simplified process flow. Also, various programmable features such as changes to cycle timing, water temperatures, or pump velocity are not reflected in the FIG. 10 flow. Each of these may be individually present and are described in more detail with respect to the description corresponding to FIG. 8B.

Various embodiments of the invention have been described in fulfillment of the various objectives of the invention. It should be recognized that these embodiments are merely illustrative of the principles of the present invention. Numerous modifications and adaptions thereof will be readily apparent to those skilled in the art without departing from the spirit and scope of the present invention as defined in the following claims.

What is claimed is:

1. A system comprising:

a tub that provides tub access to a seated user and includes a top surface, a bottom surface, and a concave well therebetween;

a platform that includes water openings extending therethrough;

a lift, coupled to a bottom surface of the platform, the lift disposed within the tub and configured to lower the platform within the well; and a plurality of jets around an inner periphery of the well, configured to apply a liquid cleaning solution within the tub in response to the lift and the platform are in a raised position and water has been drained from the well.

2. The system of claim 1, comprising:

a pump, coupled to the plurality of jets, configured to distribute the liquid cleaning solution through the plurality of jets at a predetermined pressure.

3. The system of claim 2, further comprising:

a controller, coupled to the pump, configured to pressurize the liquid cleaning solution in response to a cleaning control activation.

4. The system of claim 3, further comprising:

a cleaning fluid reservoir, configured to store a concentrated cleaning solution;

a water supply, configured to provide one or more of cold or heated water; and a mixer, coupled to the cleaning solution reservoir and the water supply, configured to combine the concentrated cleaning solution with the one or more of cold or heated water at a predetermined concentration to produce the liquid cleaning solution, wherein the mixer is coupled to an inlet of the pump.

5. The system of claim 1, further comprising:

a timer, configured to modulate the pump and mixer to:

apply the liquid cleaning solution to the well;

disable the pump for a time period;

rinse the well with the one or more of the cold or heated water to the well; and disable the pump and the mixer.

6. The system of claim 1, wherein the plurality of jets comprises one or more lower side jets and one or more upper side jets, disposed above the lower side jets.

7. The system of claim 1, wherein the plurality of jets comprises fixed jets configured to apply the liquid cleaning solution to opposite interior surfaces of the well.

8. The system of claim 1, wherein the plurality of jets comprises one or more directional jets configured to apply the liquid cleaning solution to different surfaces of the well in a repeating pattern.

9. A system, comprising:

a tub, configured to hold water, the tub comprising:

top and bottom surfaces;

a concave well, affixed and conforming to an opening at the top surface; and a drain, disposed in proximity to the bottom surface, configured to retain water within the well when closed and allow water to drain from the well when opened;

a platform, configured to fit within the opening when in a raised position;

a lift, affixed to an underside of the platform, configured to raise the platform to the raised position and lower the platform within the well; and a plurality of jets around an inner periphery of the well, configured to apply a liquid cleaning solution within the well in response to the lift and the platform are in the raised position and water has been drained from the well.

10. The system of claim 9, further comprising:

a pump, coupled to the plurality of jets, and a controller, configured to modulate the pump to provide the liquid cleaning solution to the plurality of jets in response to a cleaning control activation, the platform is in the raised position, and water is drained from the well.

11. The system of claim 10, wherein in response to the platform is not in the raised position or water is not drained from the well when the cleaning control activation occurs, the controller is configured to raise the platform to the raised position and drain the water from the well prior to the controller modulates the pump.

12. The system of claim 10, further comprising:

a mixer, coupled to the controller and the pump, configured to combine a concentrated cleaning solution with water as directed by the controller, the combination used to wash the inside of the well followed by rinsing with water.

13. The system of claim 9, wherein the plurality of jets comprises one or more directional jets configured to apply the liquid cleaning solution to different surfaces of the well in a repeating pattern.

14. A method, comprising:

receiving a cleaning control activation, and in response:

draining water within a well of a tub, in response to the drain is closed;

raising, by a lift coupled to a platform within the tub, the platform to a raised position in response to the platform is not in the raised position, the raised position being coplanar with a top surface of the tub; and in response:

applying, by a plurality of jets around an inner periphery of the well, a liquid cleaning solution within the tub.

15. The method of claim 14, further comprising:

distributing, by a pump coupled to the plurality of jets, the liquid cleaning solution to the tub at a predetermined pressure.

16. The method of claim 15, further comprising:

pressurizing, by a controller coupled to the pump, the liquid cleaning solution in response to a cleaning control activation.

17. The method of claim 16, further comprising:

storing, by a cleaning fluid reservoir, a concentrated cleaning solution;

providing, by a water supply, one or more of cold or heated water; and combining, by a mixer coupled to the cleaning solution reservoir and the water supply, the concentrated cleaning solution with the one or more of cold or heated water at a predetermined concentration to produce the liquid cleaning solution, wherein the mixer is coupled to an inlet of the pump.

18. The method of claim 17, further comprising:

modulating, by a timer associated with the controller, the pump and mixer by:

applying the liquid cleaning solution to the well;

disabling the pump for a time period;

rinsing the well with the one or more of the cold or heated water to the well; and disabling the pump and the mixer.

19. The method of claim 14, wherein in response to the cleaning control activation, the method further comprising:

determining, by the controller, a user is on the platform, and in response:

providing a request to the user to leave the platform; and inhibiting applying the liquid cleaning solution within the tub until the controller determines the user is not on the platform.

20. The method of claim 14, wherein the plurality of jets comprises one or more directional jets configured to apply the liquid cleaning solution to different surfaces of the well in a repeating pattern.

* * * * *